US009064435B2

(12) United States Patent
Forte et al.

(10) Patent No.: US 9,064,435 B2
(45) Date of Patent: Jun. 23, 2015

(54) TETHERED DISPLAY FRAME

(76) Inventors: Michael A. Forte, Miami Beach, FL (US); Joseph M. Geraci, Singer Island, FL (US)

( * ) Notice: Subject to any disclaimer, the term of this patent is extended or adjusted under 35 U.S.C. 154(b) by 0 days.

(21) Appl. No.: 12/203,467

(22) Filed: Sep. 3, 2008

(65) Prior Publication Data

US 2010/0050485 A1 Mar. 4, 2010

(51) Int. Cl.
*G09F 21/02* (2006.01)

(52) U.S. Cl.
CPC ..... *G09F 21/02* (2013.01)

(58) Field of Classification Search
USPC ..... 40/586
See application file for complete search history.

(56) References Cited

U.S. PATENT DOCUMENTS

| | | | | | |
|---|---|---|---|---|---|
| 2,342,005 | A | * | 2/1944 | Mittag | 250/462.1 |
| 2,527,258 | A | | 10/1950 | Kahn | |
| 2,589,409 | A | | 3/1952 | Leichter | |
| 2,647,261 | A | | 8/1953 | Rassner | |
| 2,685,690 | A | | 8/1954 | Chrisman | |
| 2,986,743 | A | | 6/1961 | Eilen | |
| 3,167,782 | A | * | 2/1965 | Wilson et al. | 2/1 |
| 3,214,852 | A | * | 11/1965 | Ford et al. | 40/640 |
| 3,484,974 | A | | 12/1969 | Culmore | |
| 3,582,993 | A | * | 6/1971 | Keller | 2/74 |
| 3,724,101 | A | | 4/1973 | Slezak | |
| 3,829,995 | A | | 8/1974 | Fakoury | |
| 4,195,836 | A | * | 4/1980 | Beyer | 273/431 |
| 4,218,781 | A | | 8/1980 | Lieberman | |
| 4,481,682 | A | * | 11/1984 | Hall | 2/326 |
| D280,860 | S | * | 10/1985 | Monferrato | D29/101.4 |
| 4,651,355 | A | | 3/1987 | White | |
| 4,924,613 | A | * | 5/1990 | Levin | 40/586 |
| 5,025,581 | A | * | 6/1991 | Polzin | 40/776 |
| 5,054,127 | A | | 10/1991 | Zevchak | |
| 5,129,105 | A | * | 7/1992 | Kleinman | 2/328 |
| 5,170,917 | A | * | 12/1992 | Tourigny | 224/221 |
| 5,379,461 | A | | 1/1995 | Wilmers | |
| 5,632,044 | A | * | 5/1997 | Sloot | 2/102 |
| 5,690,411 | A | | 11/1997 | Jackman | |
| 5,802,613 | A | | 9/1998 | Marshall | |
| 5,943,698 | A | | 8/1999 | Blanks | |
| 6,035,449 | A | | 3/2000 | Galler et al. | |

(Continued)

FOREIGN PATENT DOCUMENTS

| | | |
|---|---|---|
| CA | 2219826 | 5/1998 |
| GB | 2278534 | 12/1994 |

(Continued)

OTHER PUBLICATIONS

Drawings from Related U.S. Appl. No. 12/172,916 (16 pages).

(Continued)

*Primary Examiner* — Shin Kim
(74) *Attorney, Agent, or Firm* — Michael I. Kroll

(57) ABSTRACT

A tethered display frame has a planar backer sheet, a top sheet of transparent or translucent material overlaying the planar backer sheet, a border attached along a common periphery of the planar backer sheet and the top sheet, a plurality of straps fastened to the frame, and a fastener affixed to distal ends of each of the straps whereby the frame can be releasably fastened to an article. The border encloses the planar backer sheet and the top sheet on three sides with a fourth side providing means for a user to insert a display item between the top sheet and the planar backer sheet.

3 Claims, 27 Drawing Sheets

(56) References Cited

U.S. PATENT DOCUMENTS

| | | | | |
|---|---|---|---|---|
| 6,106,130 | A * | 8/2000 | Harding | 362/108 |
| 6,129,126 | A | 10/2000 | Restivo | |
| 6,199,731 | B1 | 3/2001 | Lehoux | |
| 2003/0172430 | A1 | 9/2003 | Jarrett | |

FOREIGN PATENT DOCUMENTS

| | | |
|---|---|---|
| WO | 2010008414 | 1/2010 |
| WO | 2010027379 | 3/2010 |

OTHER PUBLICATIONS

Specification from Related U.S. Appl. No. 12/172,916 (39 pages).
Claims from Related U.S. Appl. No. 12/172,916 (6 pages).
Office Action mailed Jun. 19, 2009 from Related U.S. Appl. No. 12/172,916 (8 pages).

* cited by examiner

TETHERED DISPLAY FRAME

BACKGROUND OF THE INVENTION

1. Field of the Invention

The present invention relates generally to frames and, more specifically, to a portable, removably attachable frame having either shoulder straps with suspender type clips or other means of attachment to secure the frame to an apparel or item for display as an accessory item. The user will insert a picture, famous quote, personal saying, school club, sports or celebrity photo, holiday greeting, music, movie related paraphernalia, art, comic, cartoons, poems, advertisement or any form of verbal or pictorial communication within said frame for personal or business purposes.

2. Description of the Prior Art

There are other display devices designed for ornamentation. Typical of these is U.S. Pat. No. 518,780 issued to George O. Fogg on Apr. 24, 1894.

Another patent was issued to Yates on Jan. 10, 1905 as U.S. Pat. No. 779,898. Yet another U.S. Pat. No. 1,047,779 was issued to Francis on Dec. 17, 1912 and still yet another was issued on Nov. 28, 1922 to Brady as U.S. Pat. No. 1,436,854.

Another patent was issued to Mittag on Feb. 15, 1944 as U.S. Pat. No. 2,324,005. Yet another U.S. Pat. No. 2,821,035 was issued to Joseph on Jan. 28, 1958. Another was issued to Wilson et al. on Feb. 2, 1965 as U.S. Pat. No. 3,167,782 and still yet another was issued on Nov. 30, 1971 to Beals as U.S. Pat. No. 3,624,686.

Another patent was issued to Mitchell on Sep. 1, 1998 as U.S. Pat. No. 5,800,900. Yet another U.S. Pat. No. 6,115,948 was issued to Mitchell on Sep. 12, 2000. Another was issued to Peterson et al. on Mar. 27, 2007 as U.S. Pat. No. 7,194,828 and still yet another was issued on Jan. 23, 2002 to Masahiko as Japan Patent No. JP2002/020920.

U.S. Pat. No. 518,780

Inventor: George O. Fogg

Issued: Apr. 24, 1894

A sign-staff comprising a rod having a portion thereof coiled to form a spring, substantially as and for the purpose set forth, and so forth.

U.S. Pat. No. 779,898

Inventor: Robert D. Yates

Issued: Jan. 10, 1905

In a detachable pocket device, the combination, with a body comprising an interiorly arranged reinforcing means, a facing and backing secured upon said reinforcing means, and a pocket connected with said facing, of an attaching device at each extreme end of said body for detachably securing said body to a garment, substantially as and for the purposes set forth.

U.S. Pat. No. 1,047,779

Inventor: George E. Francis

Issued: Dec. 17, 1912

An advertising appliance comprising front and rear casings, advertising devices located within the casings, shoulder straps attached to the casings for supporting the appliance upon the shoulders of a person, a cross piece arranged at one side of the casings and connecting the upper ends thereof and having a pendent bracket, a box mounted upon the cross piece, a spring motor located within the box, connecting means between the motor and the advertising devices contained in the said casings, a pendulum rod pivoted to the before mentioned pendent bracket, a ratchet wheel and pawl between the pendulum rod and motor spring for winding the latter, an arm for engaging the spring barrel to prevent movement thereof, and a dog rotatable with the ratchet wheel and adapted to trip the said arm to release the said motor at predetermined intervals.

U.S. Pat. No. 1,436,854

Inventor: James M. Brady

Issued: Nov. 28, 1922

A device of the class, described, comprising a pocket having a mouth, the walls of the pocket adjacent the mouth having openings therein, an attaching strap for attaching the pocket to a garment, the strap being insertable through the said openings to retain within the pocket a card or the like inserted therein, and. means for separably connecting the extending portion of the strap to the garment.

U.S. Pat. No. 2,324,005

Inventor: George Mittag

Issued: Feb. 15, 1944

A luminescent warning device adapted to be worn by a person and to exhibit sufficient luminescence to give a visual warning of the presence of the wearer in the dark, said device comprising a pad having an outer exposed surface of sufficient area to cover substantially the chest of the wearer from just below the shoulders to and including the waist, said exposed portion of the pad comprising a flexible fibrous sheet with the outer surface thereof forming a relatively open fibrous structure, said outer surface having a thin coating of a luminescent paint, and means for securing said pad in operative position on the chest of the wearer.

U.S. Pat. No. 2,821,035

Inventor: Raymond C. Joseph

Issued: Jan. 28, 1958

Apparatus for accommodating and displaying a hunting license or the like on the body of a person, said apparatus comprising a flat rectangular sheath having two closely spaced, substantially parallel walls at least one of which is transparent, said sheath having an open edge through which the license or the like may be inserted; an elongate elastic fabric band at each end of the sheath connected to the sheath with the free ends of each band secured to the same end of said sheath at the corners thereof, to form unconnected stretchable loops each receiving one of the person's arms and shoulders whereby said sheath may be held snugly on the person's back with said transparent wall facing rearwardly of the person.

U.S. Pat. No. 3,167,782

Inventor: Porter C. Wilson et al.

Issued: Feb. 2, 1965

In an adjustable and reversible identification apparel of plastic material for athletic contests, crossed shoulder straps, each strap having front and, back portions adapted to extend around a torso of a wearer, in front and in back, numeral designation on a background of doubled plastic material on said front and back portions, said shoulder straps—positioned between said doubled material, stays located on the lower 'portions of said straps whereby loosening of the straps is minimized, connecting plates secured to the ends of the crossed shoulder straps, each shoulder strap forming a loop adapted to extend around the torso with the respective ends of said strap attached to a respective common connecting plate, and an adjustable, reversible: belt background of doubled plastic material having loops formed thereon to receive a belt of comparable material, said belt cooperating with said loops when said belt background is folded on itself and opposing belt loops aligned, a buckle secured on the ends of said belt, tie-down cords secured to each of said connecting plates and said belt whereby said connected parts are maintained in relative adjustment.

U.S. Pat. No. 3,624,686

Inventor: Jean A. Beals

Issued: Nov. 30, 1971

An apronlike article of apparel having strips of attachment material thereon with cooperating strips of pressure-sensitive material on the backside of a multitude of pockets for removable attachment to the apron body. The pockets are of various colors for the teaching of color recognition.

U.S. Pat. No. 5,800,900

Inventor: Lawrence F. Mitchell

Issued: Sep. 1, 1998

The present invention relates to articles of clothing and footwear and more particularly to an insertable patch or emblem which fits under the overlapping layer of a pocket formed in the article of clothing or footwear. The patch or emblem and the pocket in the article include releasable attachment means.

U.S. Pat. No. 6,115,948

Inventor: Lawrence E. Mitchell

Issued: Sep. 12, 2000

The present invention relates to articles of clothing and footwear and more particularly to an insertable patch or emblem which fits under the overlapping layer of a pocket formed in the article of clothing or footwear. The patch or emblem and the pocket in the article include releasable attachment means.

U.S. Pat. No. 7,194,828

Inventor: James P. Peterson et al.

Issued: Mar. 27, 2007

An article to be worn, such as a badge, displays indicia such as identification and advertising. The article includes a housing, a first indicia member positioned on the first indicia portion of the housing and a second indicia member positioned on the second indicia portion of the housing. The first and second indicia portions are discrete from one another and can receive interchangeable indicia members. The invention further includes a method of identifying a wearer of the article, such as a sales clerk or food service preparer, and advertising a product or service, all with the same badge.

Japan Patent Number JP2002/020920

Inventor: Kawahara Masahiko

Issued: Jan. 23, 2002

PROBLEM TO BE SOLVED: To provide a clothing capable of easily taking away, fixing or changing the patterns thereon. SOLUTION: This clothing is characterized by comprising a clothing-fixed part (22) and a detachable part (21) with pattern(s), and having one of the male and female members (25) of a snap fastener on the clothing-fixed part and the mating member (24) of the snap fastener on the detachable part. The pattern(s) on the detachable part (21) include coloring, fringe, wappen, applique, brooch, fur and the like besides picture, line drawing, and photograph; it is preferable to pattern the clothing-fixed part (22) itself, and at that time, it is preferable to use the member of the snap fastener as one of the patterns.

While these displays may be suitable for the purposes for which they were designed, they would not be as suitable for the purposes of the present invention, as hereinafter described.

SUMMARY OF THE PRESENT INVENTION

The present invention is a tethered display frame having fasteners on the tethered ends whereby the display frame can be attached to apparel, personal items and structure as desired by the user. The tethered display frame serves as a Freedom of Speech (F.O.S) display frame, which can be on an individual's apparel or item that can be held by suspender clips. The F.O.S. Fashion Frame may have a strap/webbing material held by suspender clips worn over apparel or be just a permanent or portable, removably attachable frame on an apparel, accessory item or object that wants to display a message, use or purpose for personal or business reason.

The present invention provides a display frame that is attachable and detachable from apparel or portable article such as a pocketbook having means for inserting a personalized placard, such as a picture, indicia or graphic creating a Freedom of Speech Frame (F.O.S.). This F.O.S. fashion trend idea allows consumers or companies to use it either for personal or commercial use. It gives them an easily mobile, portable frame that can be removed as an accessory item worn with their own clothing that gives an individual easy access within the frame so they can display, advertise anything they so desire and want to share publicly. This F.O.S. fashion frame is made of clear plastic or clear plastic-matte finish or translucent material with or without border that resembles a picture frame that varies with a special fabric that is sewn, or with hook and loop (Velcro) fasteners, snaps, buttons or zippers so that the item which is placed inside this frame, is secured and not able to slide, as well as be easily viewed through the sleeve. This fashion frame permits freedom of expression within the limits of the law to anyone who wishes to wear it. The user can alter and change the item in the frame as often and as conveniently to reflect his own interest. This new fashion frame allows individuals or companies to advertise or display temporarily, as they wish, but still keep their own personal taste of apparel or clothing which reflects their own personality. It allows individuals or companies to alter or recycle the messages or display items. This will avoid waste and avoid outdated items that are no longer of interest. Due to our technological computer driven society, the display frame permits individuals or companies to utilize their skills and be their own advertiser maker thus being current and up to date with the times on a day to day basis. This idea allows one to have more control of printed material worn on one's own body. This idea not only saves the individual money by not having to buy, for example multiple T-shirts or garments one wants displayed on oneself. It also allows the messages or printed material to be more intricate, tasteful and professional since there are no limitations. Freedom of Expression, one of our fundamental American rights, will be enhanced by this product since each individual will decide the words and pictures that are to be displayed.

Every American will have the responsibility to know and understand the current "freedom of speech laws" as they apply to the display. This F.O.S. Fashion Trend item has many uses such as famous quotes, personal sayings in words, school clubs, sports celebrity photos, school sports teams, anniversary photos for celebrations, birthday party celebrations and holidays. For example, for St. Patrick's Day one can wear an Irish Flag or show photograph of oneself or family member in Ireland or display "one's own pet" in a green leprechaun hat. Non-profit organizations, conventions, corporate training or artists who want to show their own art work through photos, photographers, entrepreneurs can advertise their own business. Individuals can show political support for candidates or views on specific issues, positive affirmations, poems, personal photos of loved ones, family or family reunions, vacations, music or movie related items, pets photos, spouse, boyfriend, girlfriend, blog articles legal to print, computer frames with chips that display slide shows, display cartoons, jokes and comic book related paraphernalia. The uses are endless based on one's interest. This idea will be marketed to men, women, children over 6 years of age, as well as any business or corporation that wants to display a message or anyone who wishes to advertise. The F.O.S. Fashion Frame will be displayed within an accessory apparel that uses elastic or webbing or straps with suspender clips with plastic inserts, Velcro, zippers, sateen fabric, or a fabric design used for a frame style, as well as clear plastic or clear plastic-matte finish with certain items sewn to various parts, if required for personal or commercial use.

A primary object of the present invention is to provide a tethered display frame having fasteners for attachment to a desired article by means of said fasteners.

Another object of the present invention is to provide a display frame having a transparent or translucent portion for displaying an article therein.

Yet another object of the present invention is to provide a tethered display frame wherein the transparent/translucent portion is encompassed by a frame.

Still yet another object of the present invention is to provide a tethered display frame having straps fastened to the frame whereby said frame can be releasably fastened to an individual or a desired article.

Another object of the present invention is to provide a display frame with at least one side that is releasably sealable whereby the displayed item can be inserted and secured therein.

Additional objects of the present invention will appear as the description proceeds.

The present invention overcomes the shortcomings of the prior art by providing a portable, removably attachable frame having shoulder straps with suspender type clips to secure the frame to said straps as an accessory item worn over apparel or just be a permanent or portably, removably attachable frame on an apparel, accessory item or object that wants to display a message, use or purpose. The user will insert a picture, famous quote, personal saying, school club, sports or celebrity photo, holiday greeting, music/movie related paraphernalia, art, comics, cartoons, poems, advertisement or any form of verbal or pictorial communication within said frame for personal or business purpose.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
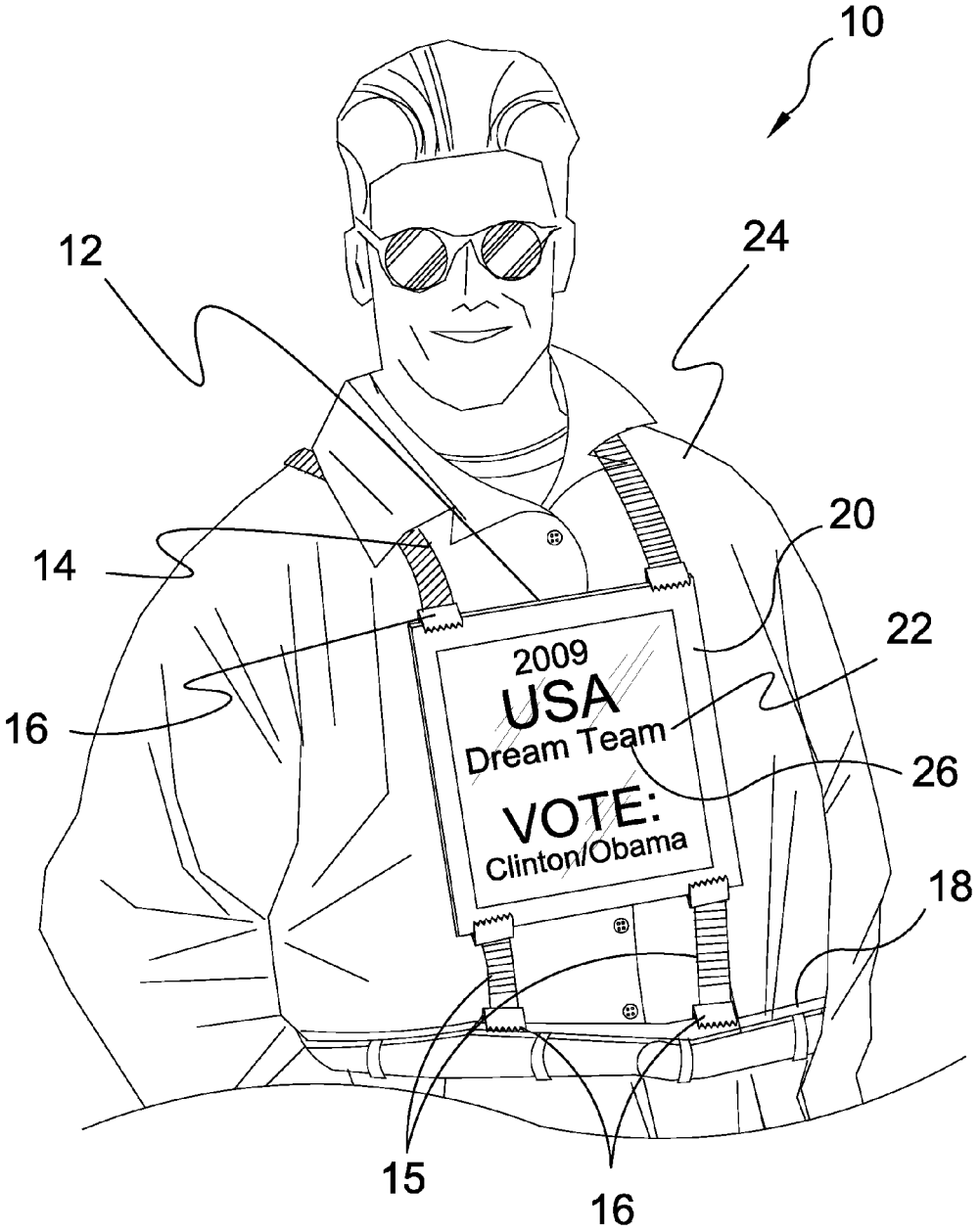
FIG. 1 is an illustrative view of the display frame of the present invention in use.

Turning now descriptively to the drawings, in which similar reference characters denote similar elements throughout the several views, the figures illustrate the Tethered Display Frame of the present invention. With regard to the reference numerals used, the following numbering is used throughout the various drawing figures.

10 Tethered Display Frame of the present invention
12 display frame
14 shoulder strap
15 bottom strap
16 suspender type clip
18 apparel/garment
20 border of 12
22 transparent top sheet of 12
23 planar backer sheet of 12
24 user
26 display item
28 belt
30 strap length adjustment member
32 front display frame
34 rear display frame
36 fixed shoulder strap
38 fixed bottom strap
40 stitching
42 decorative pattern
44 display item insertion means
46 fastener element
48 frame "A"
50 frame "B"
52 frame "C"
54 hook and loop fastener
56 top strap
58 knapsack
60 article
62 shoulder bag
64 single suspender clip with plastic inserts
66 double suspender clip
68 single clip attachable strap
70 top of 12
72 mail box
74 permanently sewn frame
76 snaps
78 buttons
80 zippers
82 adhesive

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the wearable display frame 12 of the present invention 10 in use. The present invention 10 is a portable, removably attachable frame 12 having shoulder straps 14 and bottom straps 15 terminating in suspender type clips 16 to secure the frame 12 to apparel 18 or other articles. The frame 12 is comprised of a planar backer sheet with a border 20 attached along the periphery covering a sheet of transparent top sheet 22 and the frame 12 is enclosed on all sides using various fastener elements, such as, snaps, Velcro, zippers, buttons or other sewn elements. Another frame variation would enclose three sides with a fourth side providing means for a user to insert a personalized picture, famous quote, personal saying, school club, sports or celebrity photo, holiday greeting, music/movie related paraphernalia, art, comics, cartoons, poems, advertisement or any form of verbal or pictorial communication within said frame for personal or business purposes. Additionally a belt is available if the user has nothing else to attach the suspender clips to. Shown is the user 24 wearing the display frame 12 having a display item 26 with the shoulder straps 14 and bottom straps 15 secured to the worn apparel 18.

Figure 2:
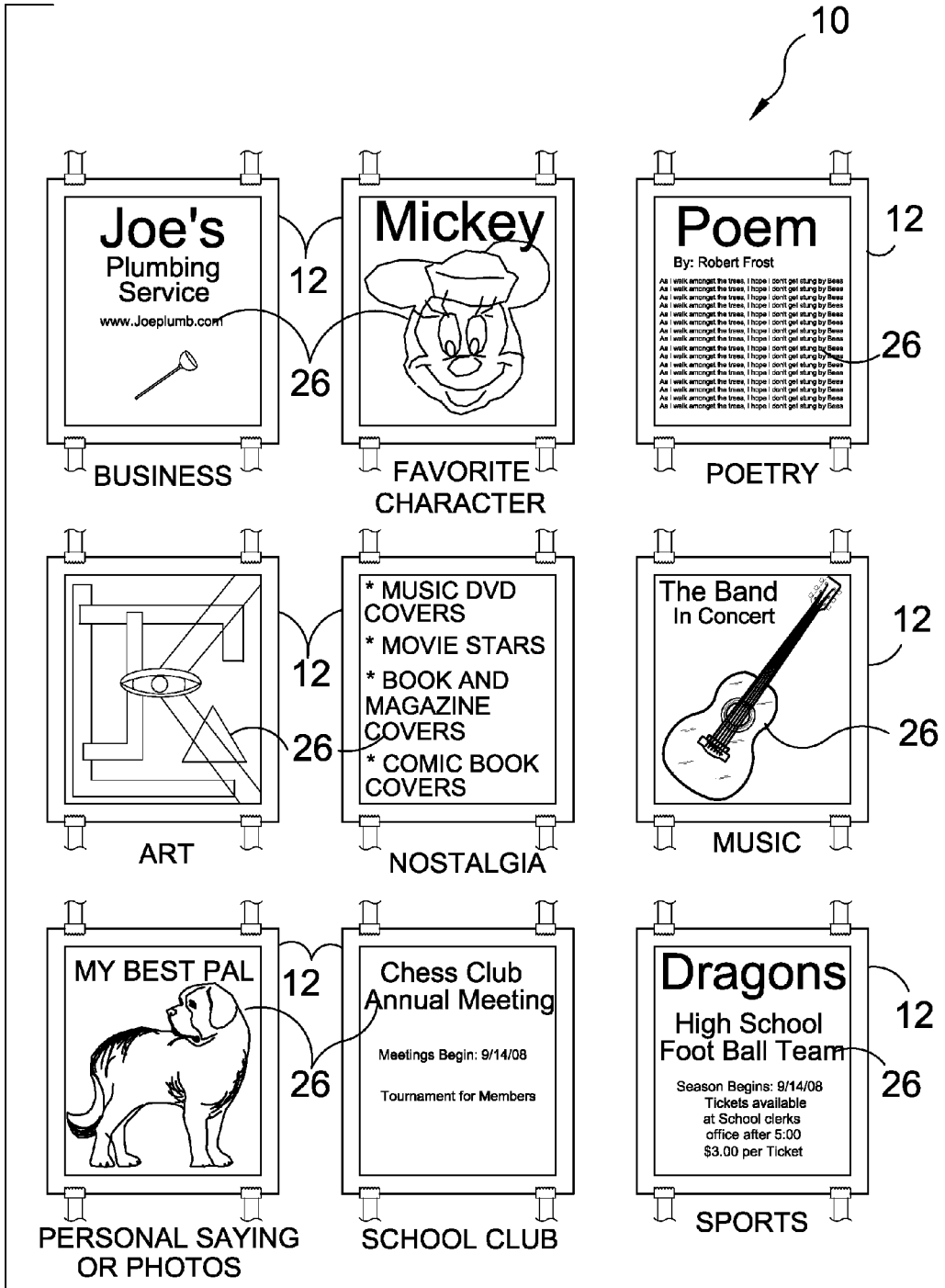
FIG. 2 is an illustrative view of various enablements of the present invention.

FIG. 2 is an illustrative view of various enablements of the present invention 10. Depicted is a plurality of frames 12 having possible variations of personalized display items 26 taken from pictures, famous quotes, personal sayings, school clubs, sports or celebrity photos, holiday greetings, music/movie related paraphernalia, art, comics, cartoons, poems, advertisement or any other form of verbal or pictorial communication for commercial or personal purposes that are inserted into the display frame 12 of the present invention 10.

Figure 3:
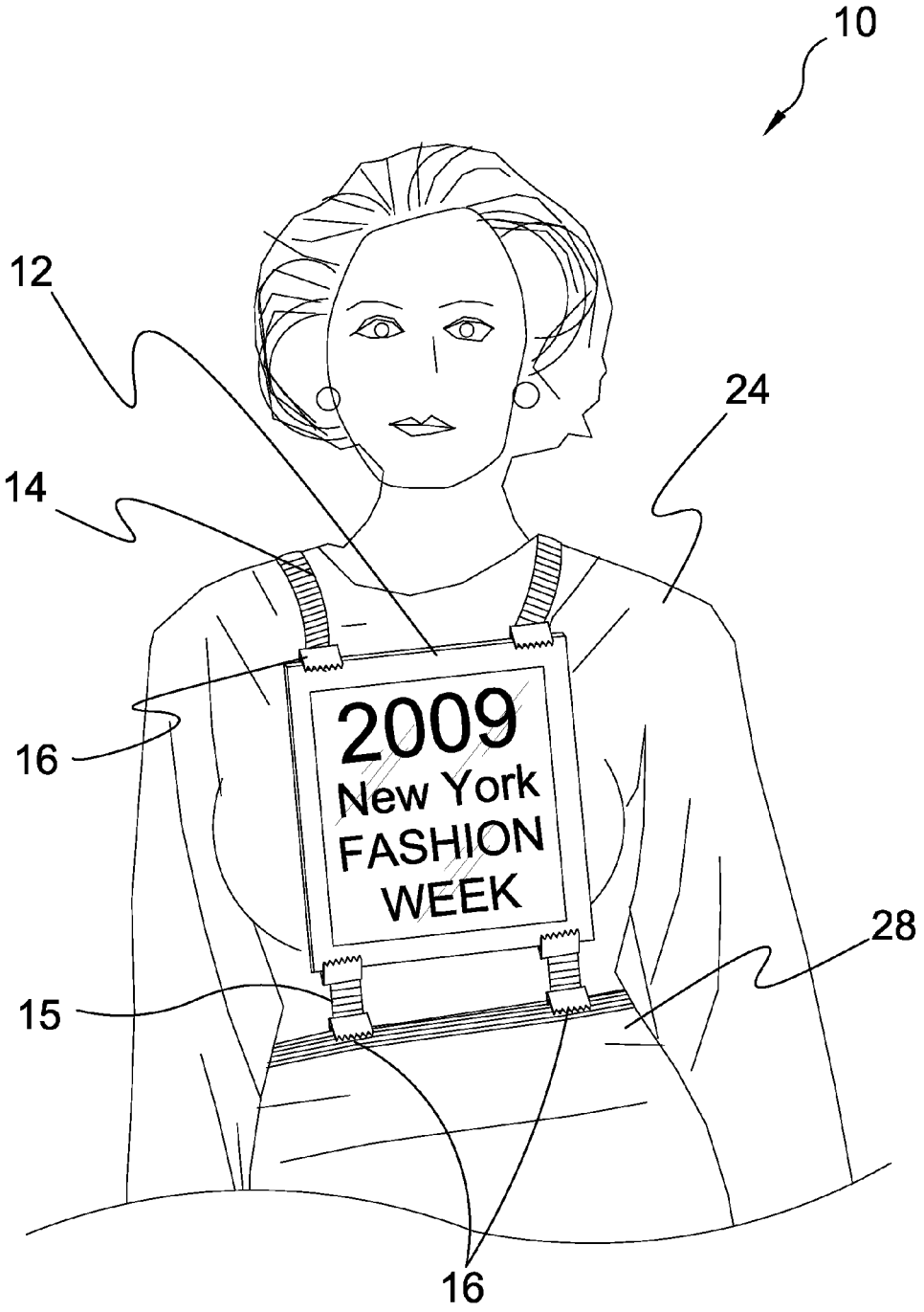
FIG. 3 is an illustrative front view of the display frame of the present invention with a belt.

FIG. 3 is an illustrative front view of the display frame 12 of the present invention 10 with a belt 28. A belt 28 is available if the user 24 has nothing else to attach the suspender clips 16 of the shoulder straps 14 and the bottom straps 15 to.

Figure 3A:
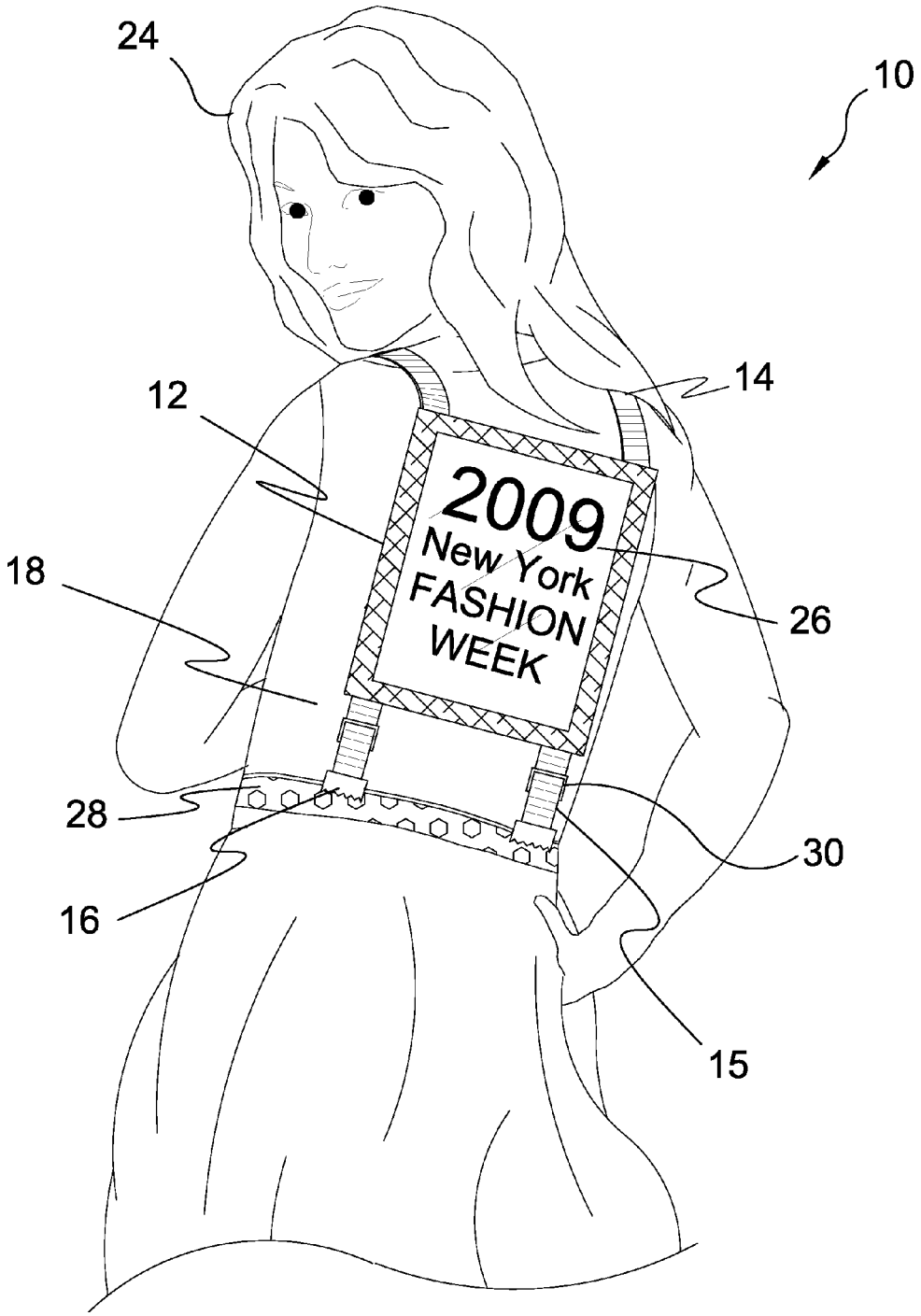
FIG. 3A is an illustrative rear view of the display frame of the present invention with a belt.

FIG. 3A is an illustrative rear view of the display frame 12 of the present invention 10 with a belt 28. Shown is one method of use of the present invention 10 which can be displayed on the front or back of a garment 18. The portable, removably attachable frame 12 has shoulder straps 14 and bottom straps 15 having length adjustment members 30 with suspender type clips 16 to secure the frame 12 to said straps as an accessory item. The user 24 will insert a display item 26 of a picture, famous quote, personal saying, school club, sports or celebrity photo, holiday greeting, music/movie related paraphernalia, art, comics, cartoons, poems, advertisement or any form of verbal or pictorial communication within said frame 12 for use or business. Additionally a belt 28 is available if the user 24 has nothing else to attach the suspender clips 16 to.

Figure 4:
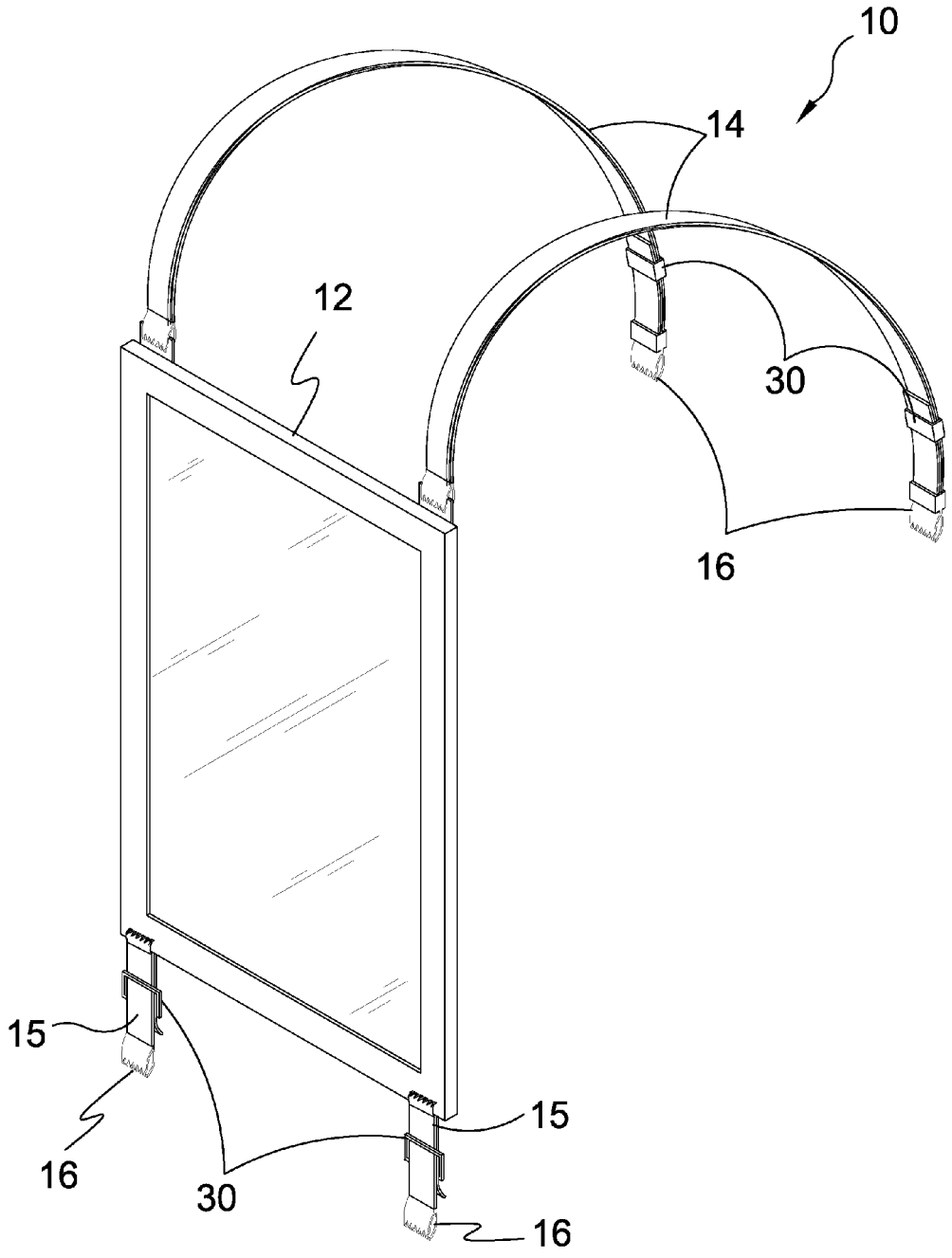
FIG. 4 is a perspective view of an additional element of the present invention.

FIG. 4 is a perspective view of an additional element of the present invention 10. Depicted is the display frame 12 of the present invention 10 having attached bottom straps 15 terminating in suspender-like clips with adjustment members 30 for varying the length of the straps. Also shown are detachable shoulder straps 14 having suspender-like clips 16 positioned on each distal end with adjustment members 30 positioned thereon for adjusting the length of the shoulder straps 14 with one end clipped to the display frame 12 while the others ends are selectively attached to apparel.

Figure 4A:
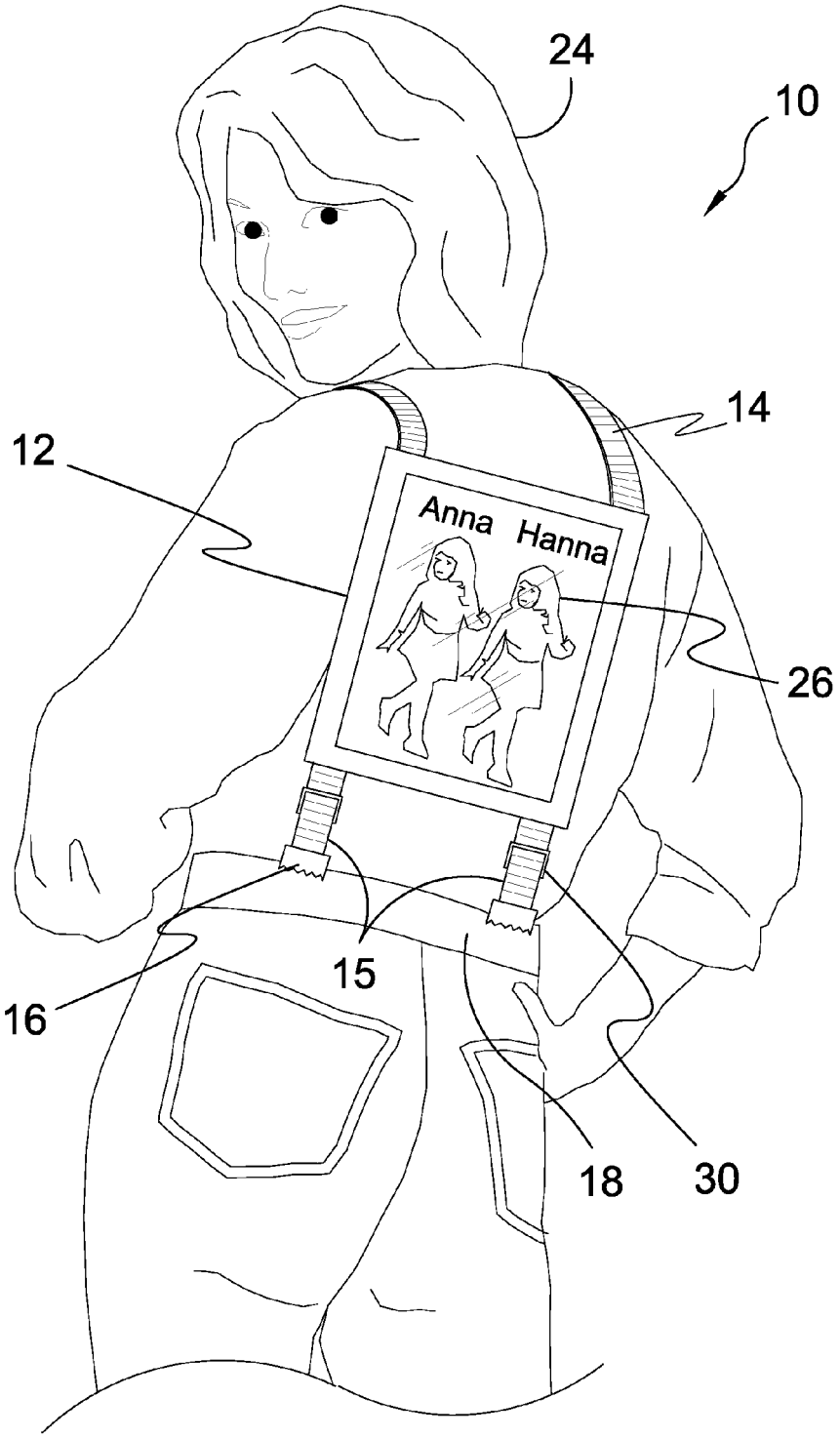
FIG. 4A is a perspective view of the additional element of the present invention in use.

FIG. 4A is a perspective view of the additional element of the present invention 10 in use. Illustrated is the display frame 12 having fixedly attached bottom straps 15 and removable shoulder straps 14 worn on the back side of the user 24 with adjustment elements 30 positioned on the straps providing for selectively adjusting the positioning of the display frame 12 and secured to the garment 18 by the clips 16. As aforementioned the user 24 can selectively insert a display item 26 such as a personalized picture, famous quote, personal saying, school club, sports or celebrity photo, holiday greeting, music/movie related paraphernalia, art, comics, cartoons, poems, advertisement or any form of verbal or pictorial communication within said frame 12 for personal or business purposes.

Figure 5:
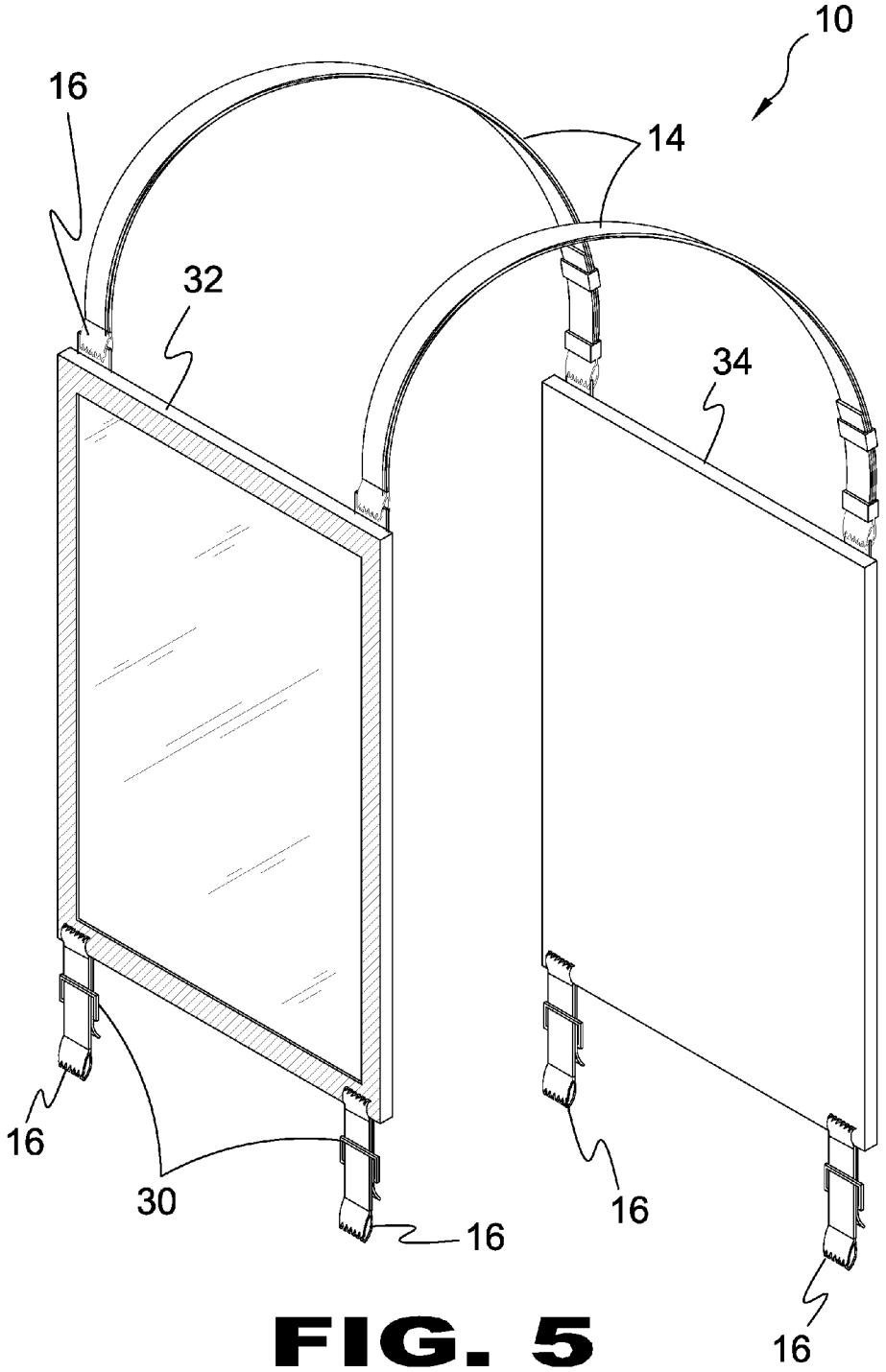
FIG. 5 is a perspective view of another additional element of the display frame of the present invention.

FIG. 5 is a perspective view of another additional element of the display frame of the present invention. Depicted is the present invention 10 comprising a front display frame 32 and a rear display frame 34 with each having fixedly attached bottom straps 15 projecting from the bottoms thereof and having adjustment members 30 positioned on the straps for varying their length accordingly. Also shown are shoulder straps 14 terminating in suspender like clips 16 for attaching to each frame also incorporating adjustment members 30 for varying their length. Each frame provides for the user to selectively insert a picture, famous quote, personal saying, school club, sports or celebrity photo, holiday greeting, music/movie related paraphernalia, art, comics, cartoons, poems, advertisement or any form of verbal or pictorial communication within said frame for personal use or business purposes.

Figure 5A:
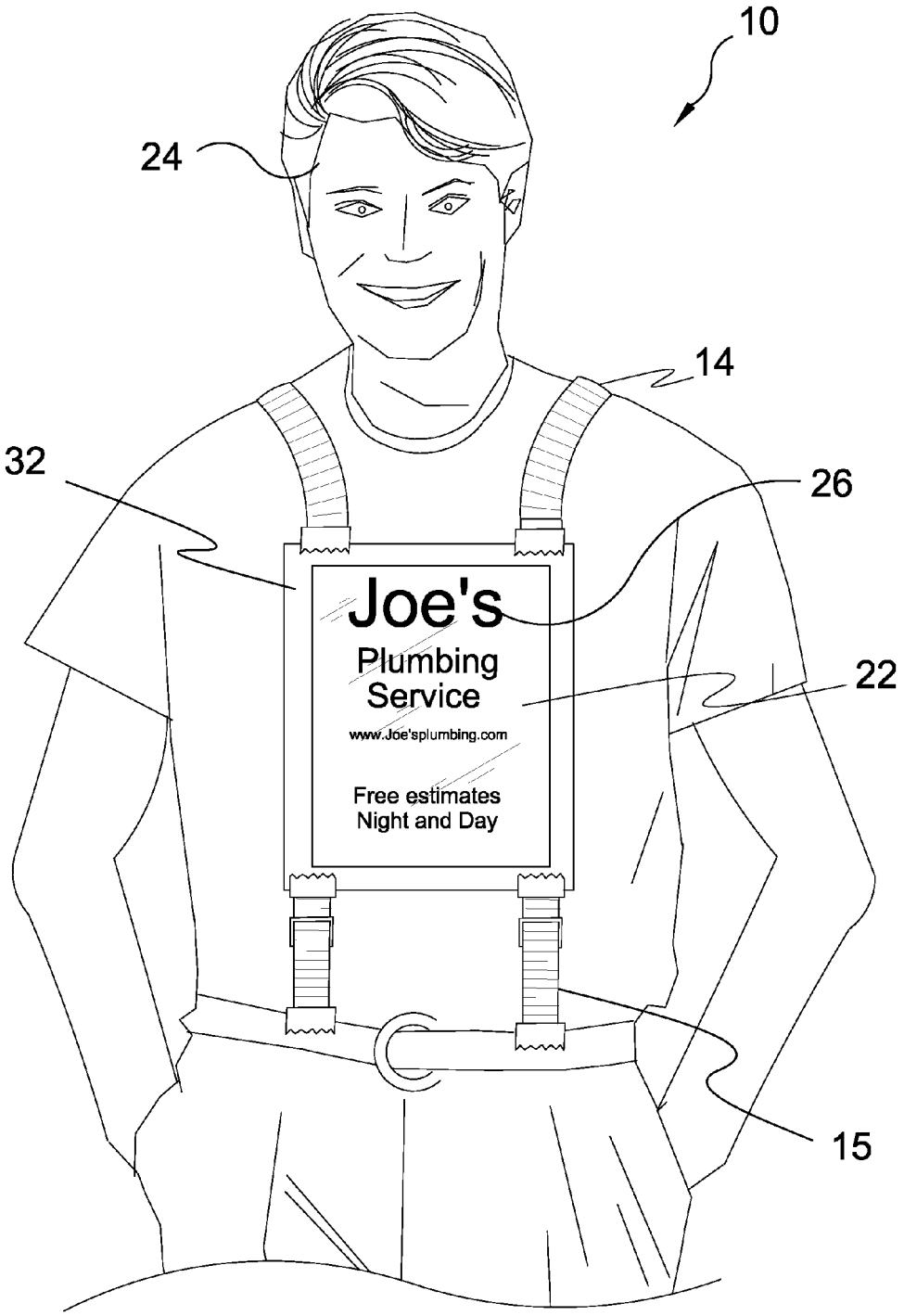
FIG. 5A is an illustrative view of the additional element of the present invention in use.

FIG. 5A is an illustrative view of the additional element of the present invention 10 in use. Illustrated is a front view of the front display frame 32 providing for the user 24 to selectively insert a display item 26 such as a picture, famous quote, personal saying, school club, sports or celebrity photo, holiday greeting, music/movie related paraphernalia, art, comics, cartoons, poems, advertisement or any form of verbal or for pictorial communication behind the transparent top sheet 22 for personal use or business purposes and adjustably fix the length of the shoulder straps 14 and bottom straps 15 to the users comfort.

Figure 6:
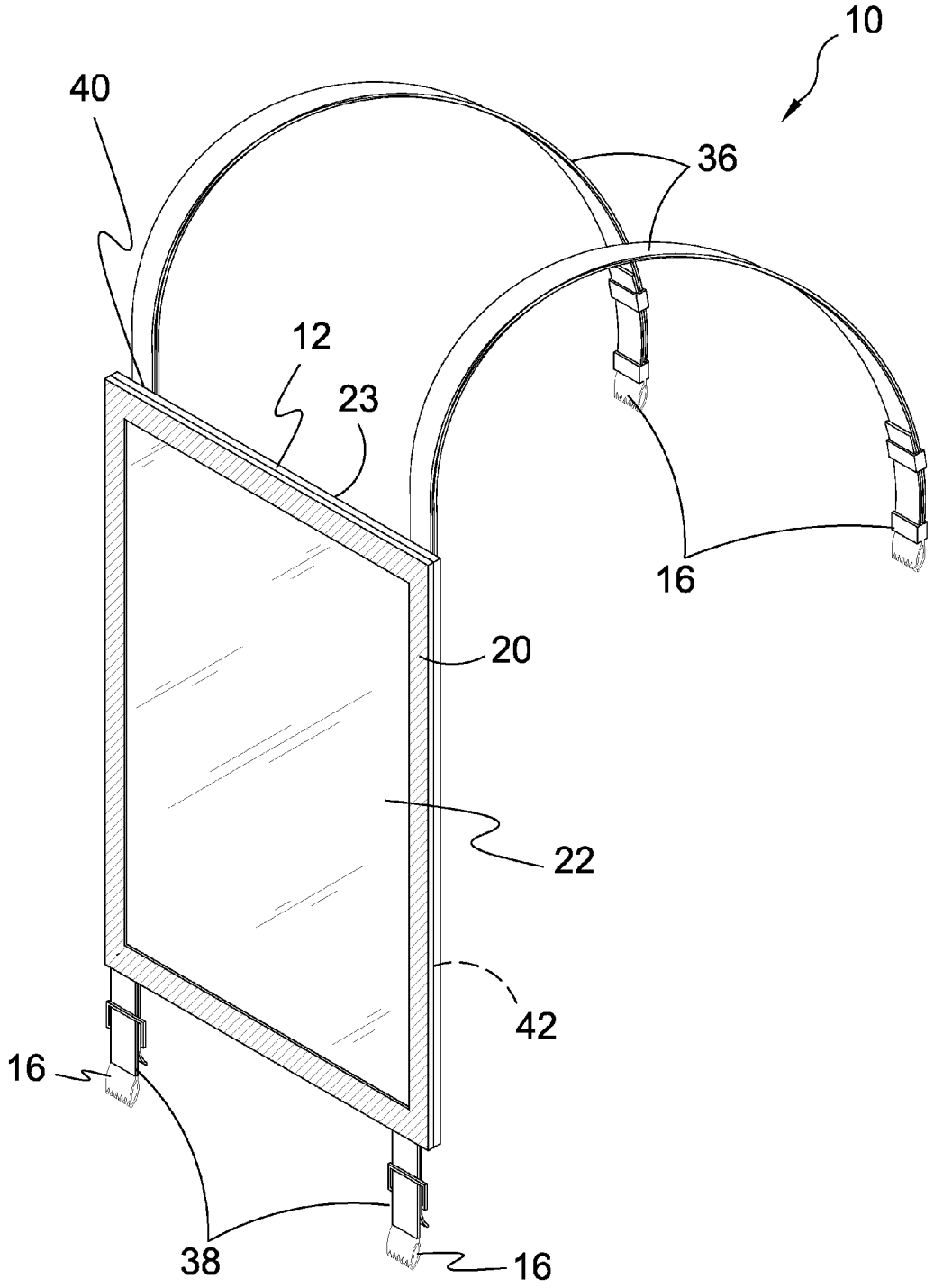
FIG. 6 is a perspective view of the display frame of the present invention.

FIG. 6 is a perspective view of the display frame of the present invention. Depicted is the present invention comprising a frame 12 having fixed shoulder straps 36 and bottom straps 38 stitched 40 thereto and terminating in suspender type clips 16 to secure the frame to apparel or other articles. The frame 12 is composed of planar backer sheet 23 with a border 20 attached along the periphery covering a sheet of transparent material 22. The frame 12 is enclosed on all sides using various fastener elements 42, such as snaps, Velcro, zippers, buttons or other sewn elements. Another frame variation would enclose the sides with a fourth side which allows items to be inserted. Also provided at the distal end of the straps are latchable fasteners, preferably suspender-like clips 16. As shown, the personalized display frame 12 can be located to the front or back of the user as desired and further provides that the display-frame 12 can have various designs.

Figure 6A:
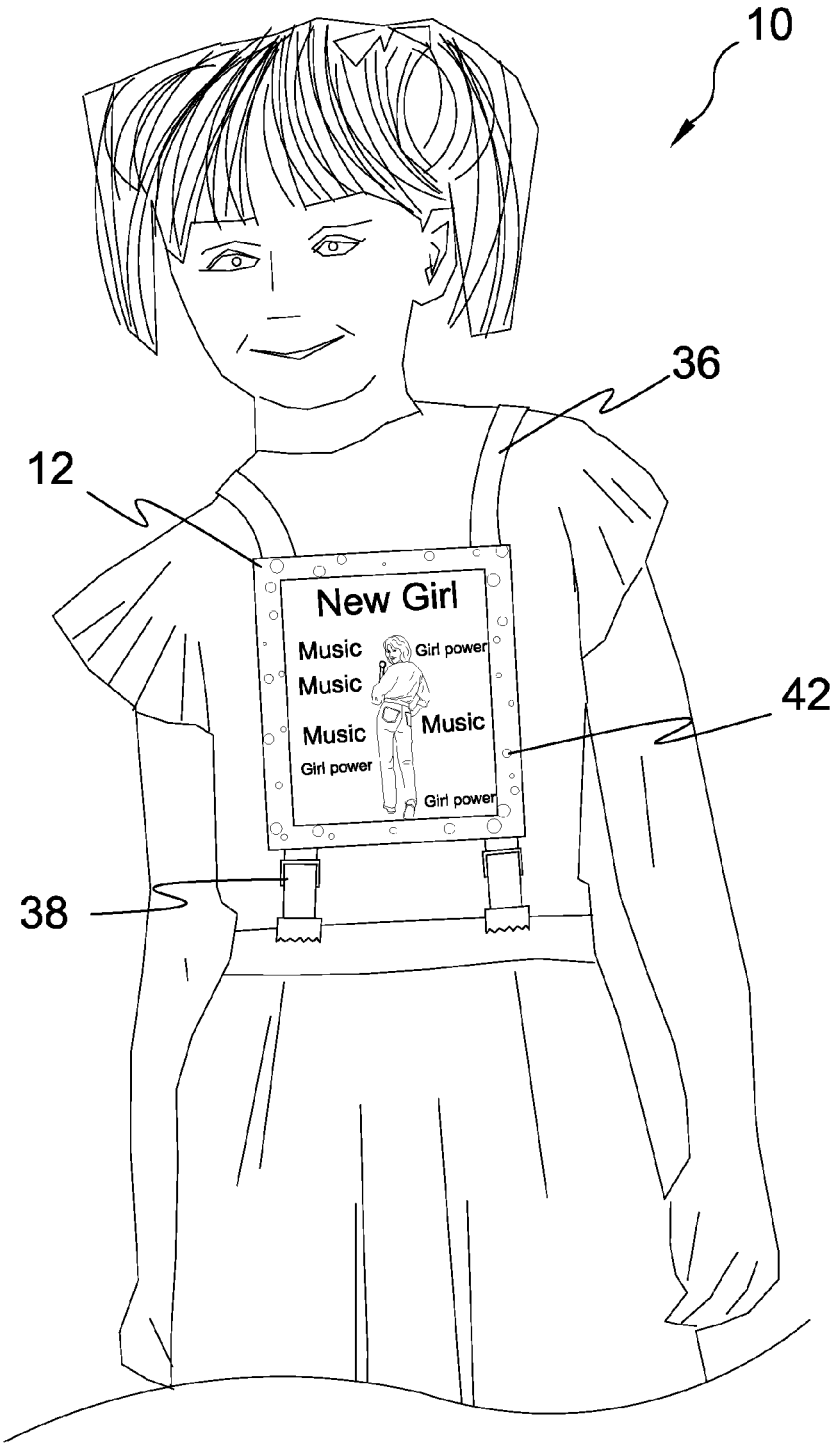
FIG. 6A is an illustrative front view of the display frame of the present invention.

FIG. 6A is an illustrative front view of the display frame 12 of the present invention 10. The display frames 12, fixed shoulder straps 36 and fixed bottom straps 38 may be available in an assortment of colors and decorative patterns 42 for aesthetic and stylistic purposes.

Figure 7:
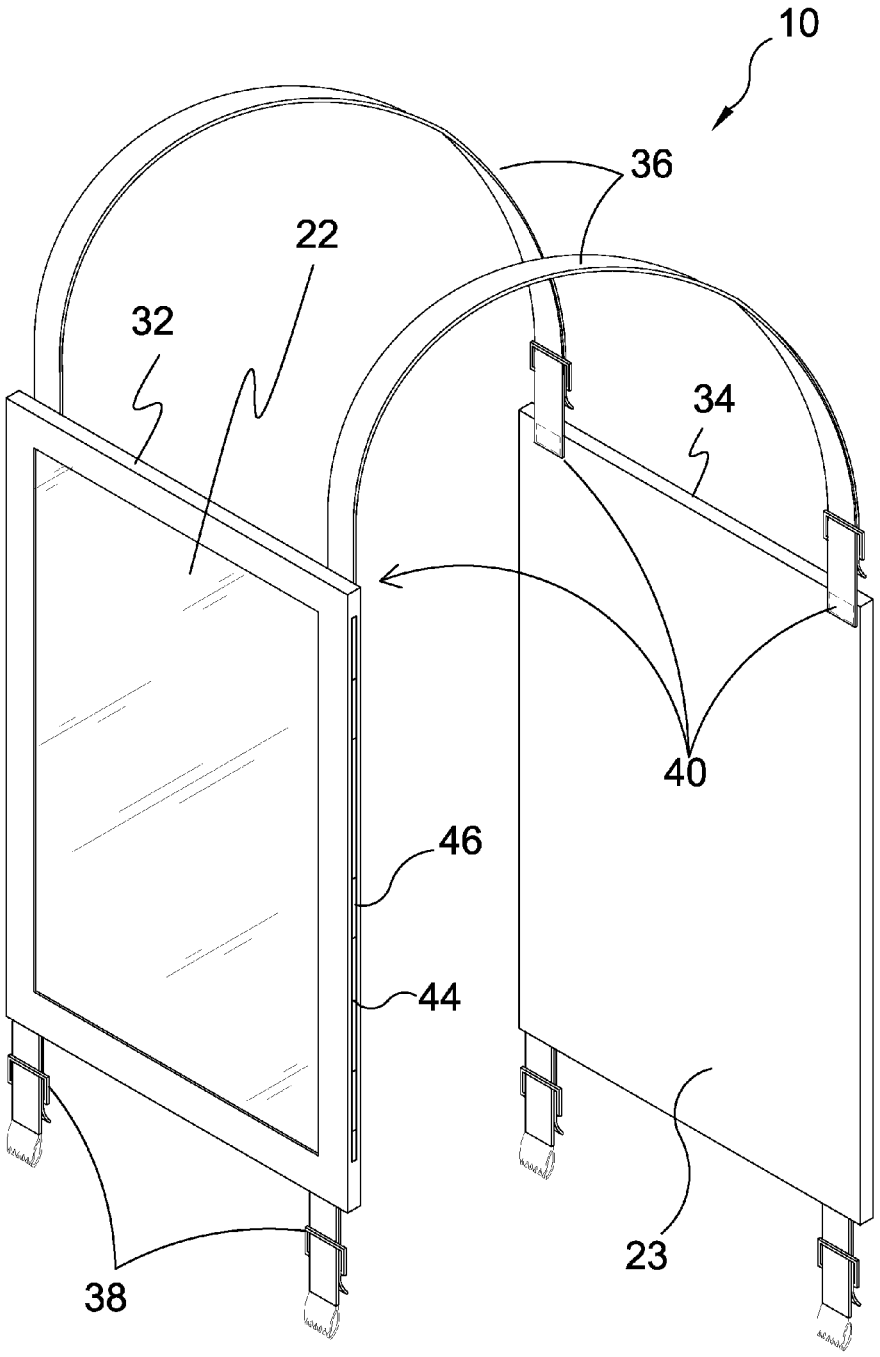
FIG. 7 is another perspective view of an additional element of the display frame of the present invention.

FIG. 7 is another perspective view of an additional element of the display frame of the present invention 10. Depicted is the present invention 10 comprising a front display frame 32 and a rear display frame 34 with each having a border 20 encompassing a transparent or translucent planar backer sheet 23 with the borders 20 attached along the periphery covering a sheet of transparent material 22 fixed on three sides with a fourth side providing a display item insertion means 44 for inserting user selected articles that will be viewable through the viewing panes. Fixedly attached between the top ends of the frames is a plurality of fixed shoulder straps 36 incorporating means for adjusting the length of the straps. Each frame has a pair of fixedly attached bottom straps 38 extending from the frames with latchable fasteners fixed on the distal ends for securing to an article of apparel with the straps having members for adjusting the lengths of the securing straps. The straps shown are stitched 40 to their respective frames. Another variation of the frame is enclosed on all sides using various fastener elements such as snaps, Velcro, zippers or other sewn elements.

Figure 7A:
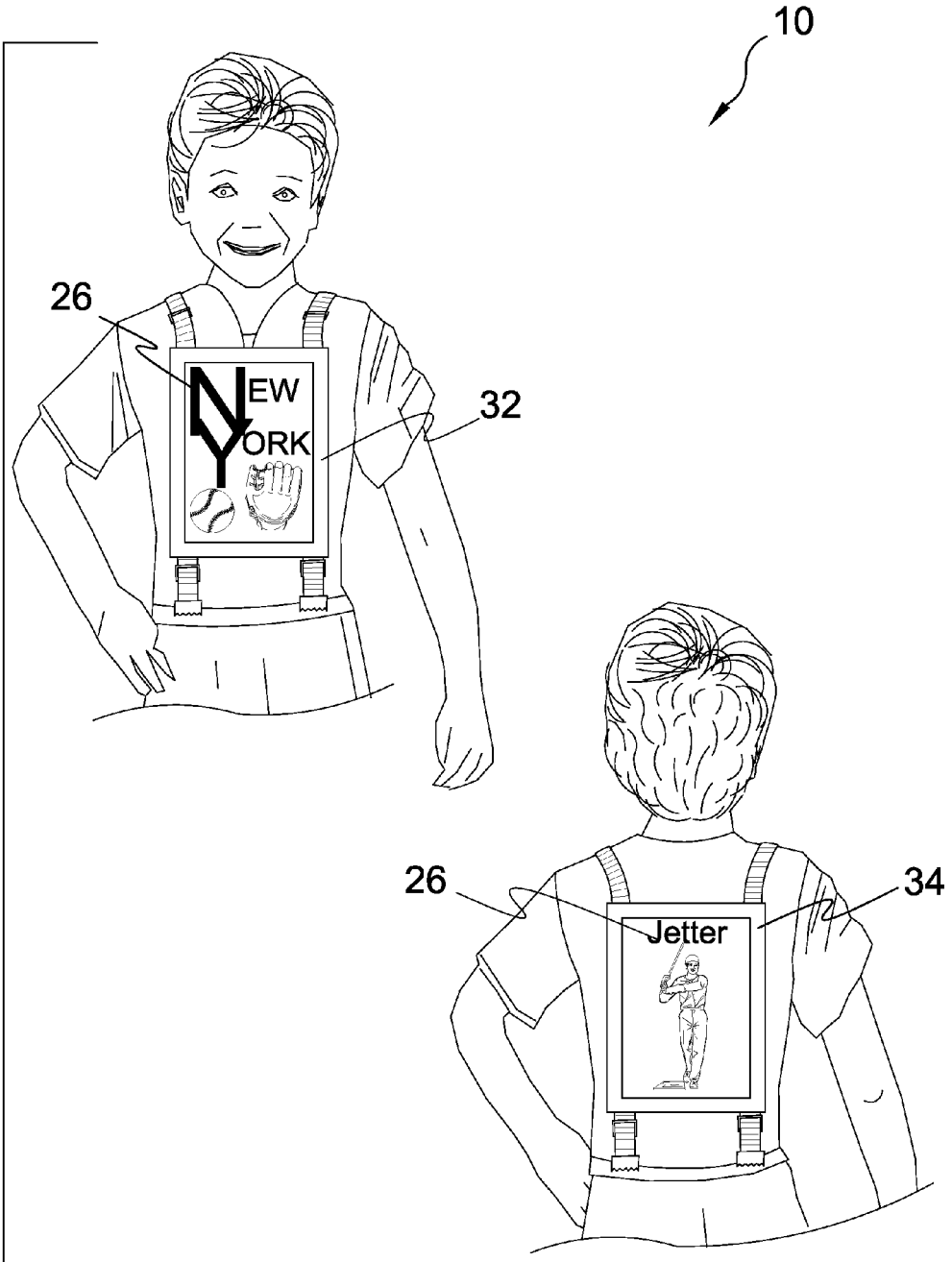
FIG. 7A is a perspective view of the double frame with sewn straps in use.

FIG. 7A is a front and rear view of the present invention 10 having complementary display items 26 inserted into the front display frame 32 and the rear display frame 34.

Figure 8:
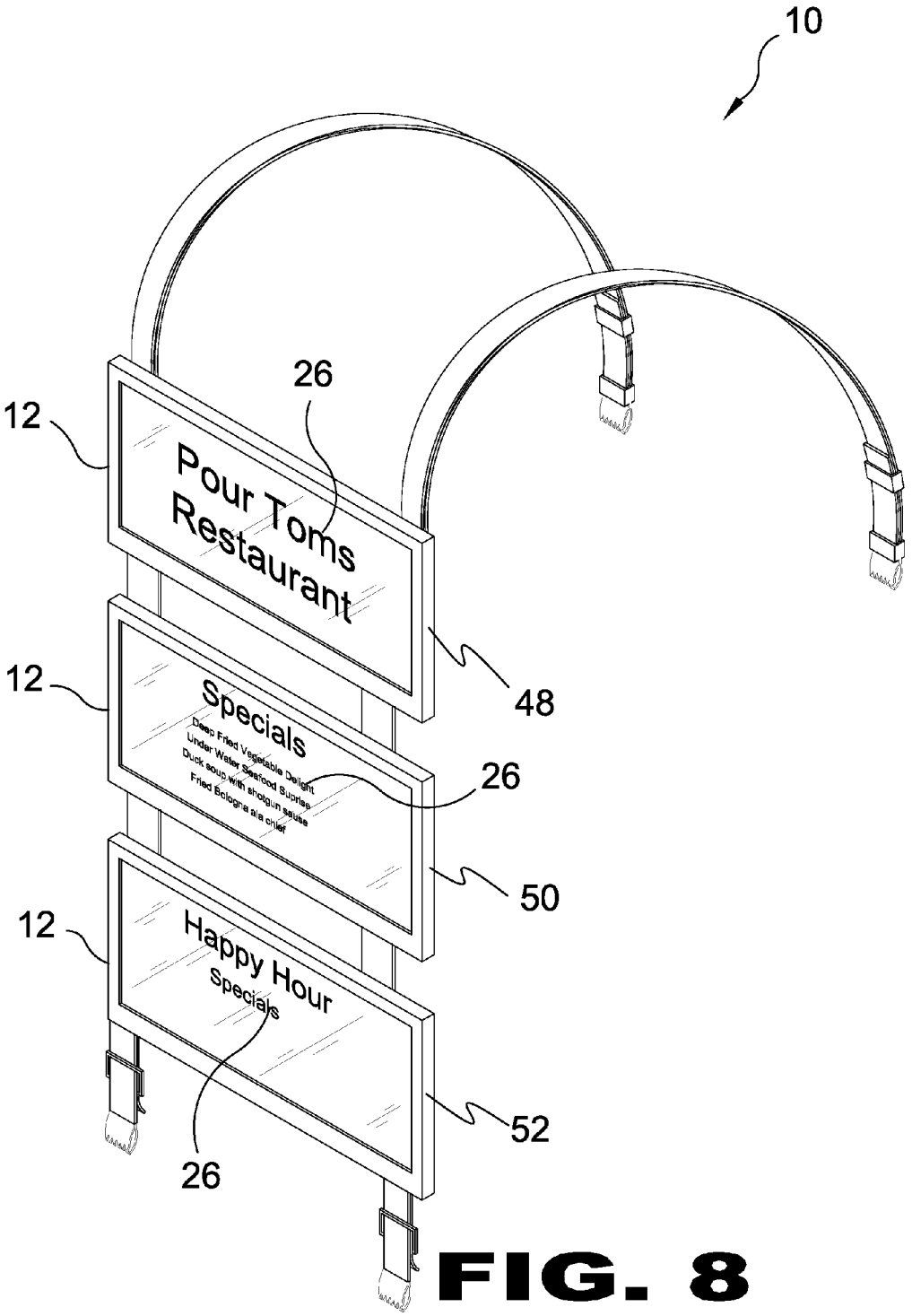
FIG. 8 is a perspective view of another additional element of the present invention.

FIG. 8 is a perspective view of multiple frames 12 with sewn straps in use. Depicted is the present invention 10 having a plurality of frames 12 represented as frame "A" 48, frame "B" 50 and frame "C" 52 with all three frames disposed on the same side to enable viewing of multiple display items 26.

Figure 8A:
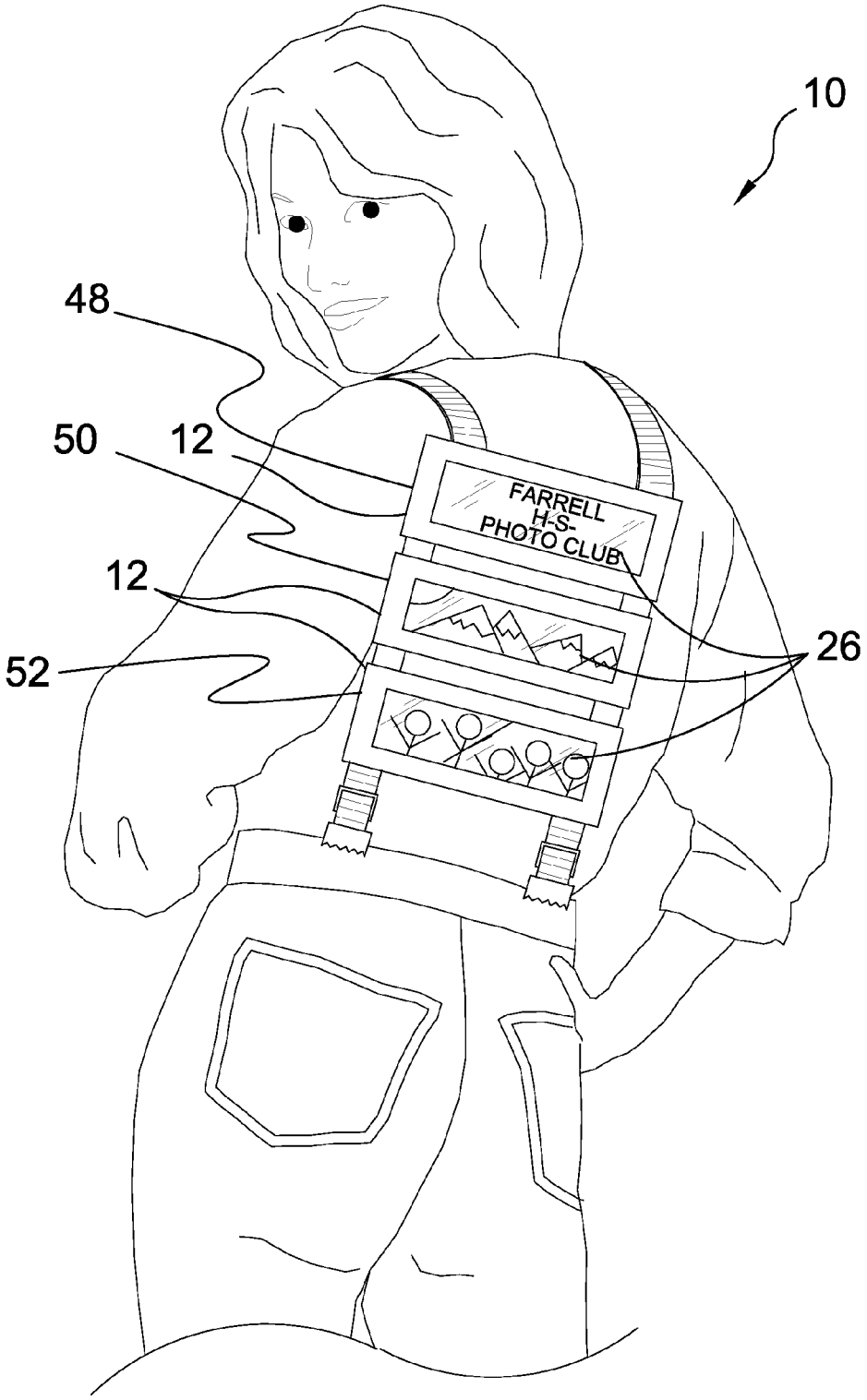
FIG. 8A is an illustrative view of the multi display frame in use.

FIG. 8A is an illustrative view of multiple frames 12 with sewn straps in use. Depicted is the present invention 10 having a plurality of frames 12 represented as frame "A" 48, frame "B" 50 and frame "C" 52 with all three frames disposed on the same side to enable viewing of multiple display items 26.

Figure 9:
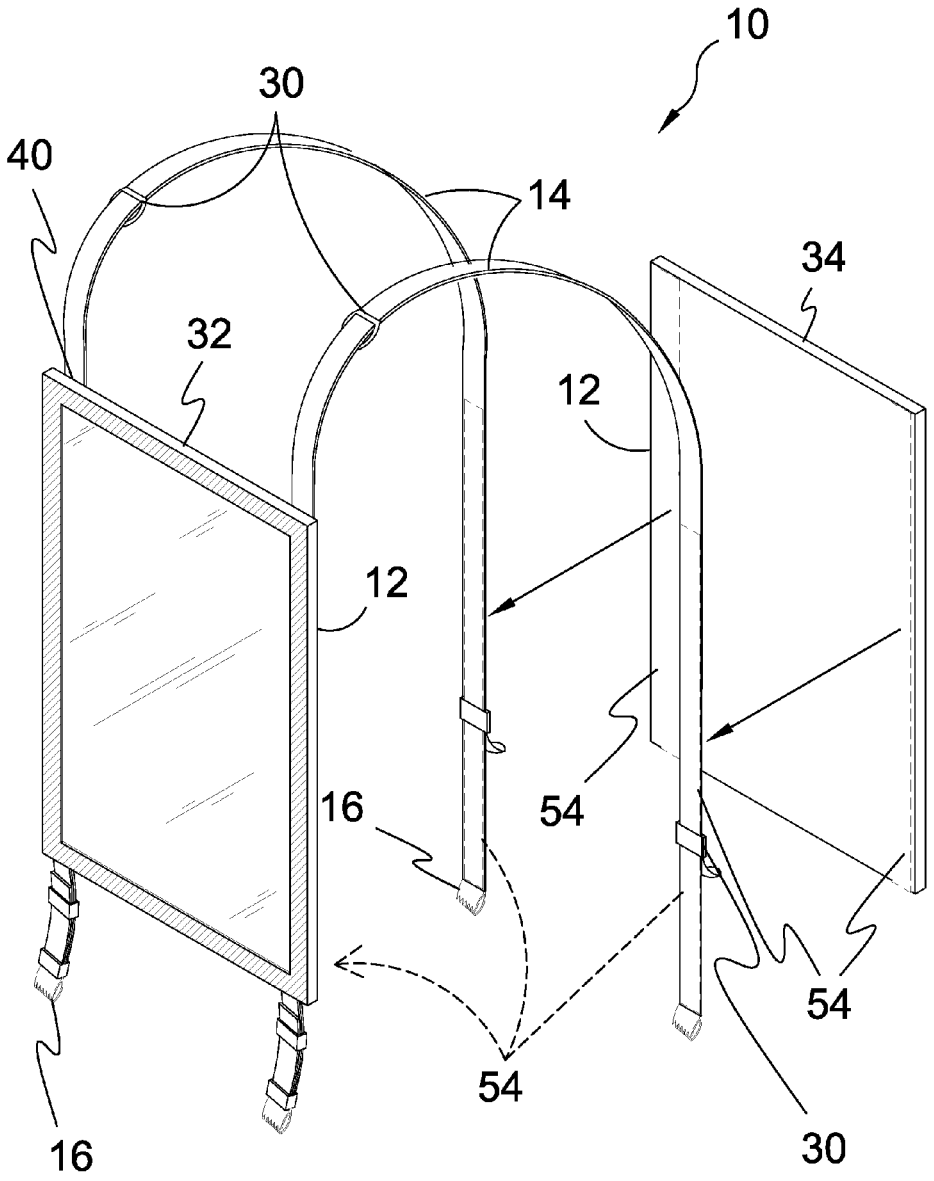
FIG. 9 is a perspective view of another additional element of the display frame of the present invention.

FIG. 9 is a perspective view of another additional element of the present invention 10. Depicted is another additional element of the present invention 10 comprising a front display frame 32 and a rear display frame 34, each having lengths of hook and loop material 54 and a pair of full length shoulder straps 14 having mating lengths of hook and loop material 52 stitched 40 thereto whereby one or more display frames 12 can be selectively attached to the straps 14. The straps 14 terminate in suspender-like clips 16 and incorporate adjustment members 30 for varying the lengths thereof.

Figure 9A:
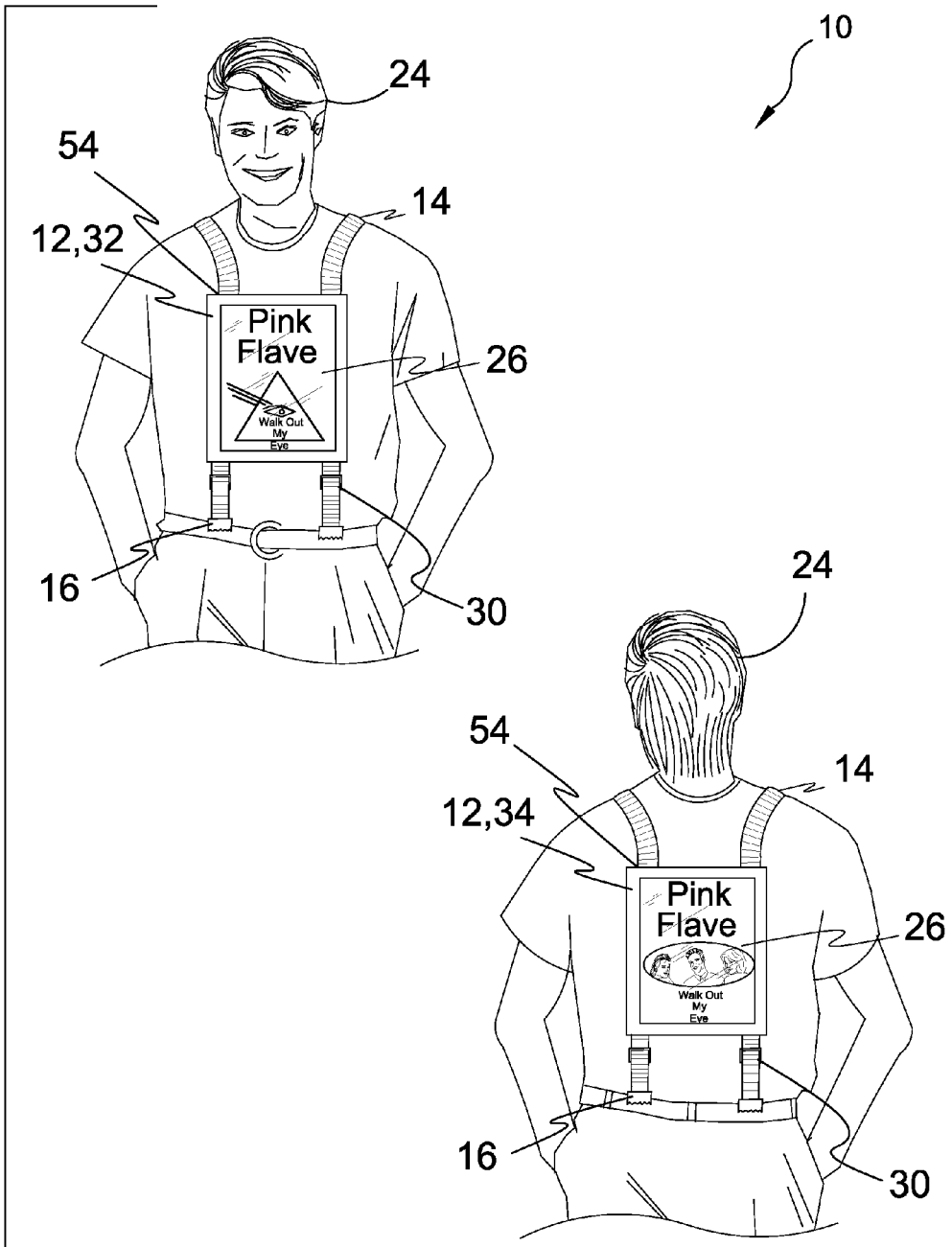
FIG. 9A is a perspective view of the strap attachable display frame in use.

FIG. 9A is a perspective view of the strap attachable display frame 12 in use. The attachable display frame 12 provides a pair of straps 14 terminating in suspender-like clips 16 having adjustment members 30 for varying the lengths of the straps 14 to the user's 24 need and lengths of hook and loop material 54 attached thereto forming a mating fastener member 54 and one or more display frames having the corresponding mating fastener member 54 whereby the user 24 can selectively attach one or more display frames 12 and can change the display frame(s) and display items 26 as desired. A front display frame 32 and a rear display frame 34 are employed in the illustration.

Figure 10:
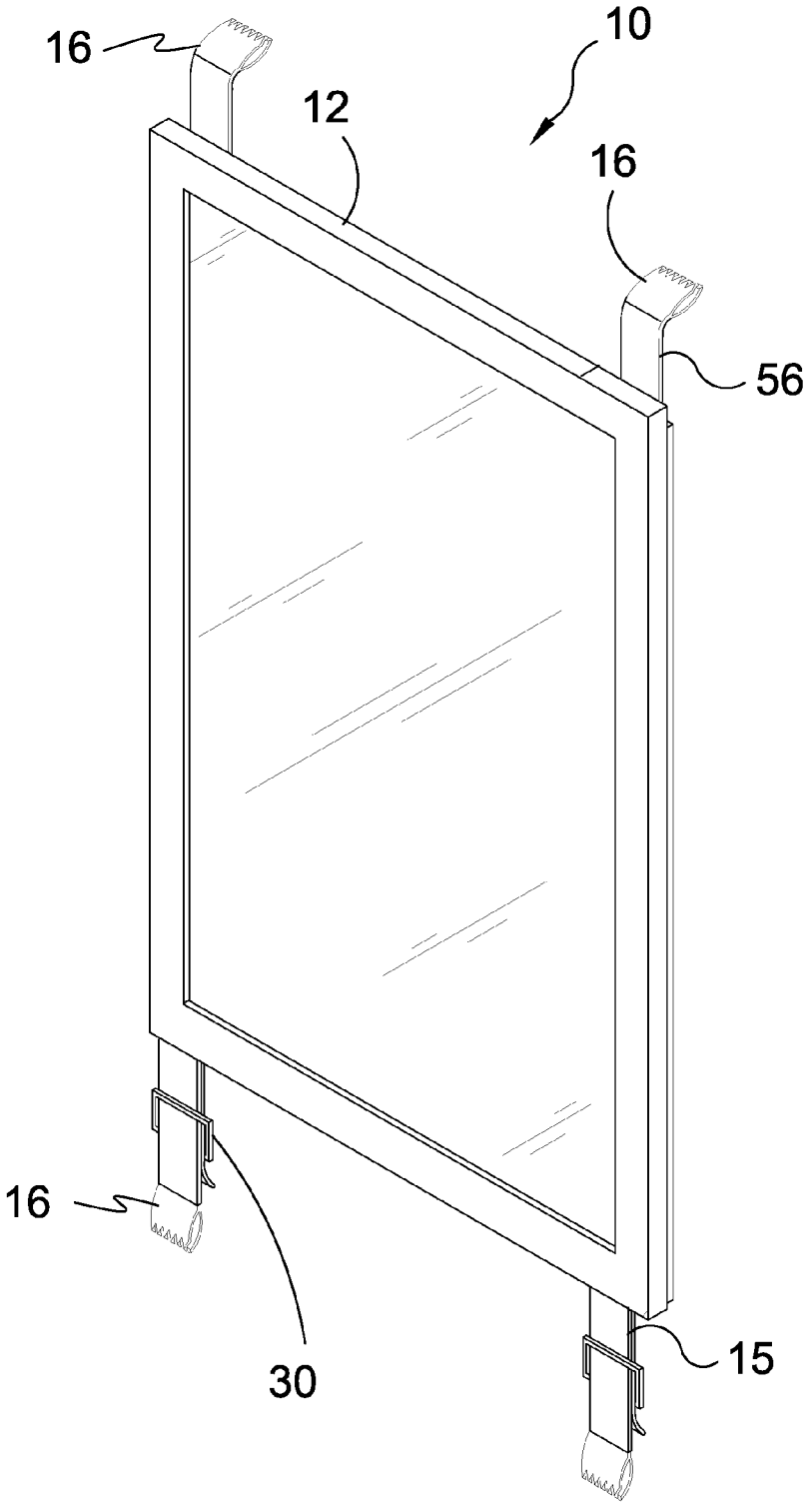
FIG. 10 is a perspective view of another additional element of the display frame of the present invention.

FIG. 10 is a perspective view of another additional element of the present invention 10 comprising a display frame 12 having a pair of top straps 56 and a pair of bottom straps 15 fixedly attached on the top and bottom of the display frame 12 with each terminating in a suspender-like clips 16 with the bottom straps 15 having adjustment members 30 for varying the lengths of the straps. The display frame 12 can be attached to an article of apparel or other desired article such as aprons, shoulder bags, knapsacks, duffel bags with or without suspender clips, and can therefore be attached by other attachments such as Velcro, Velcro adhesive, buttons, snaps, zippers or other sewn elements.

Figure 10A:
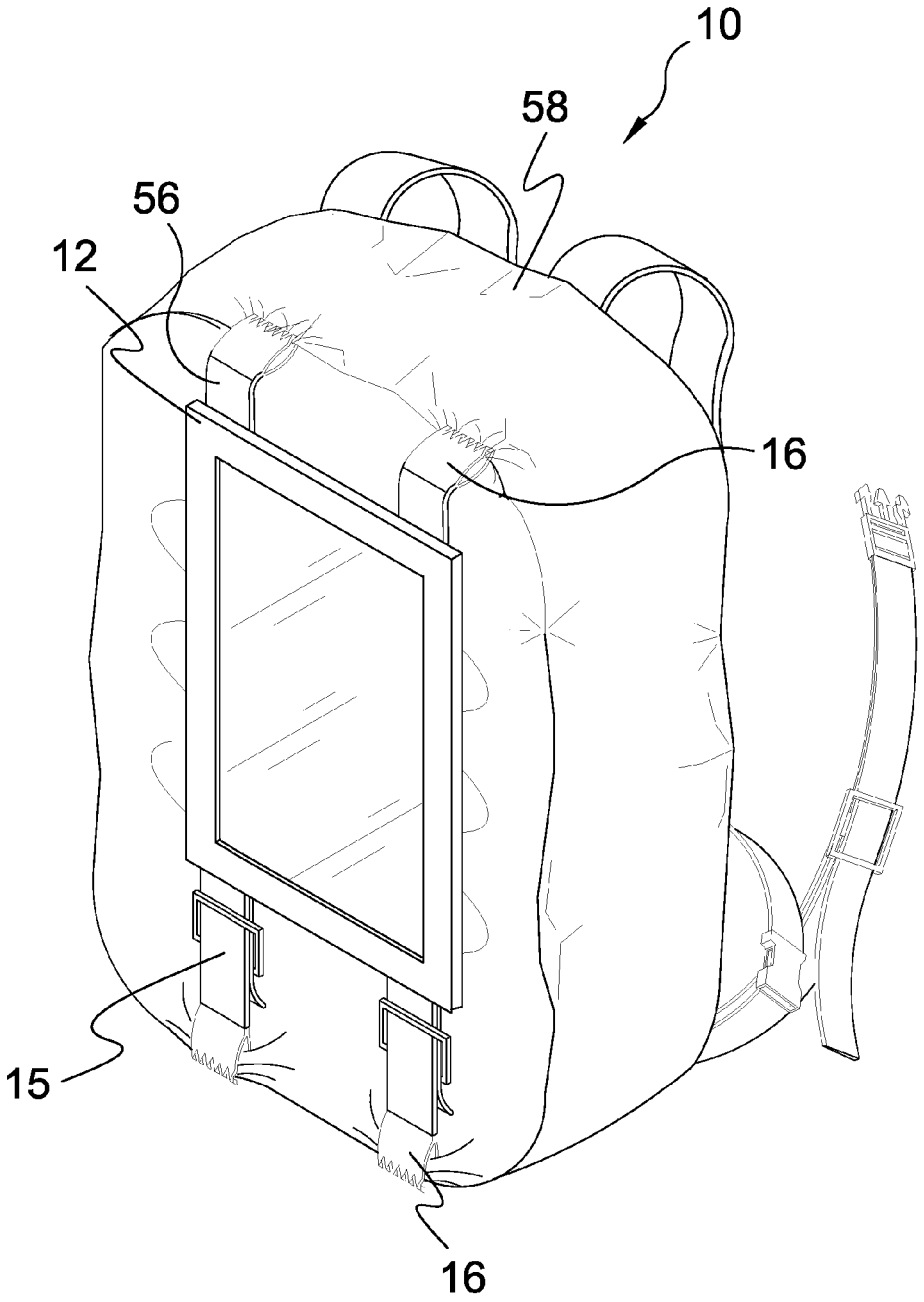
FIG. 10A is an illustrative view of the present invention.

FIG. 10A is a perspective view of the article display frame 12 of the present invention 10 secured to a knapsack 58. Also shown are the top straps 56 and bottom straps 15 having suspender-like clips 16 providing portability from one user desired article to another. The present invention 10 provides that the article may incorporate permanently attached straps and display frame which would also obviate the need for adjustment members 30.

Figure 11:
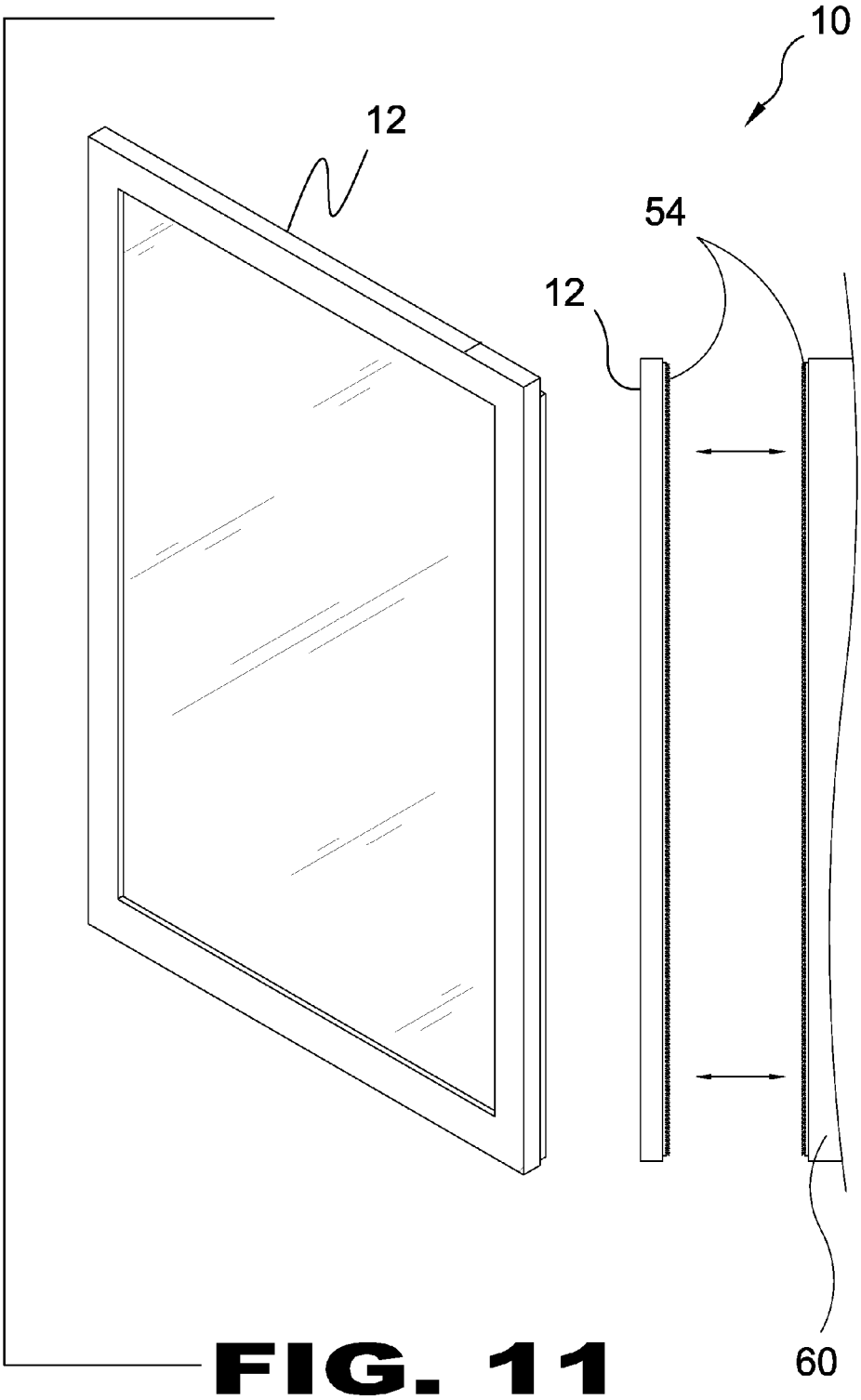
FIG. 11 is a perspective view of another additional element of the display frame of the present invention.

FIG. 11 is a perspective view of another additional element of the display frame 12 of the present invention 10. Depicted is another additional element of the present invention 10 comprising a display frame 12 having lengths of hook and loop material 54 fixed to opposing sides with mating lengths of hook and loop material 54 that can be attached to a desired article 60 wherethen the display frame 12 can be attached to any desired article 60 using the providing length of hook and loop material 54.

Figure 11A:
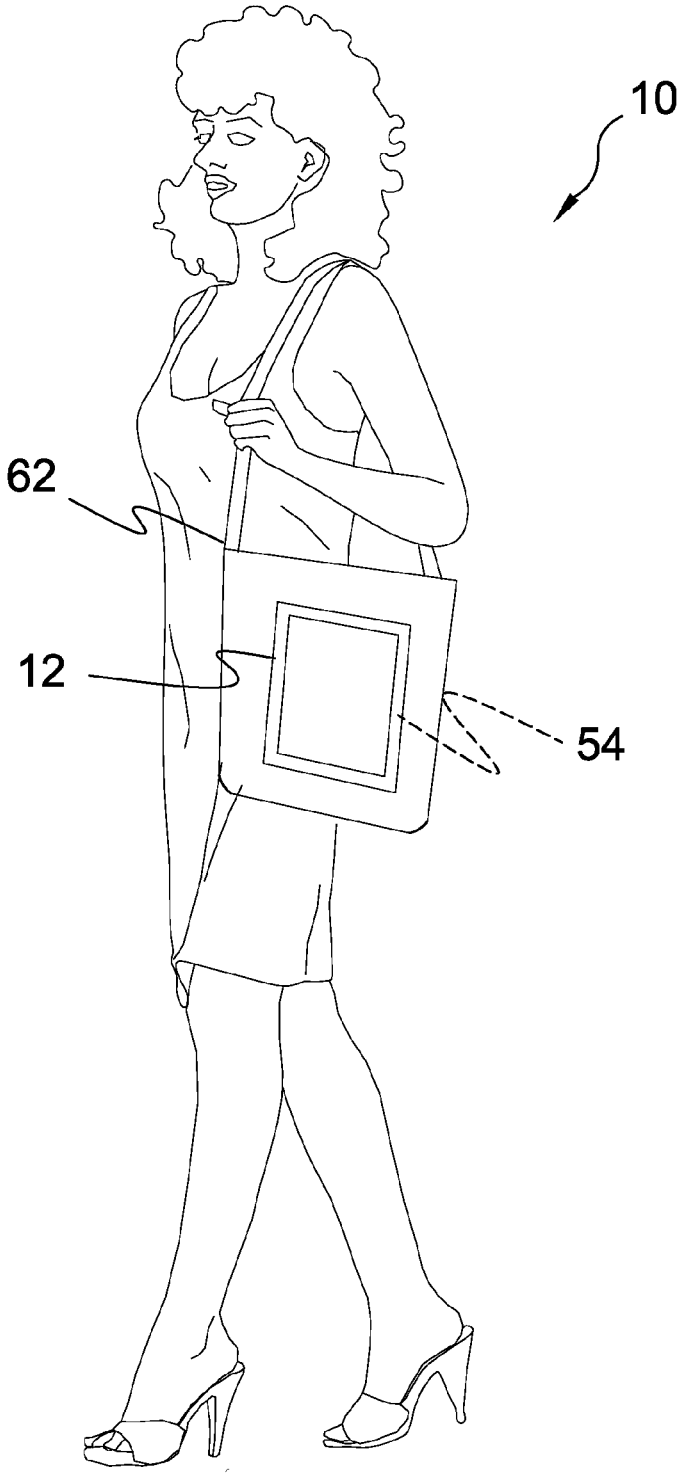
FIG. 11A is an illustrative view of the present invention.

FIG. 11A is a perspective view of the display frame 12 with hook and loop strips 54 in use with a shoulder bag 62. Illustrated is the display frame 12 of the present invention 10 providing user selected article attachable lengths of hook and loop material 54 wherethen the display frame 12 has corresponding mating lengths of hook and loop material 54 fixed to the backside of the display frame 12 can be releasably attached to any desired article.

Figure 12:
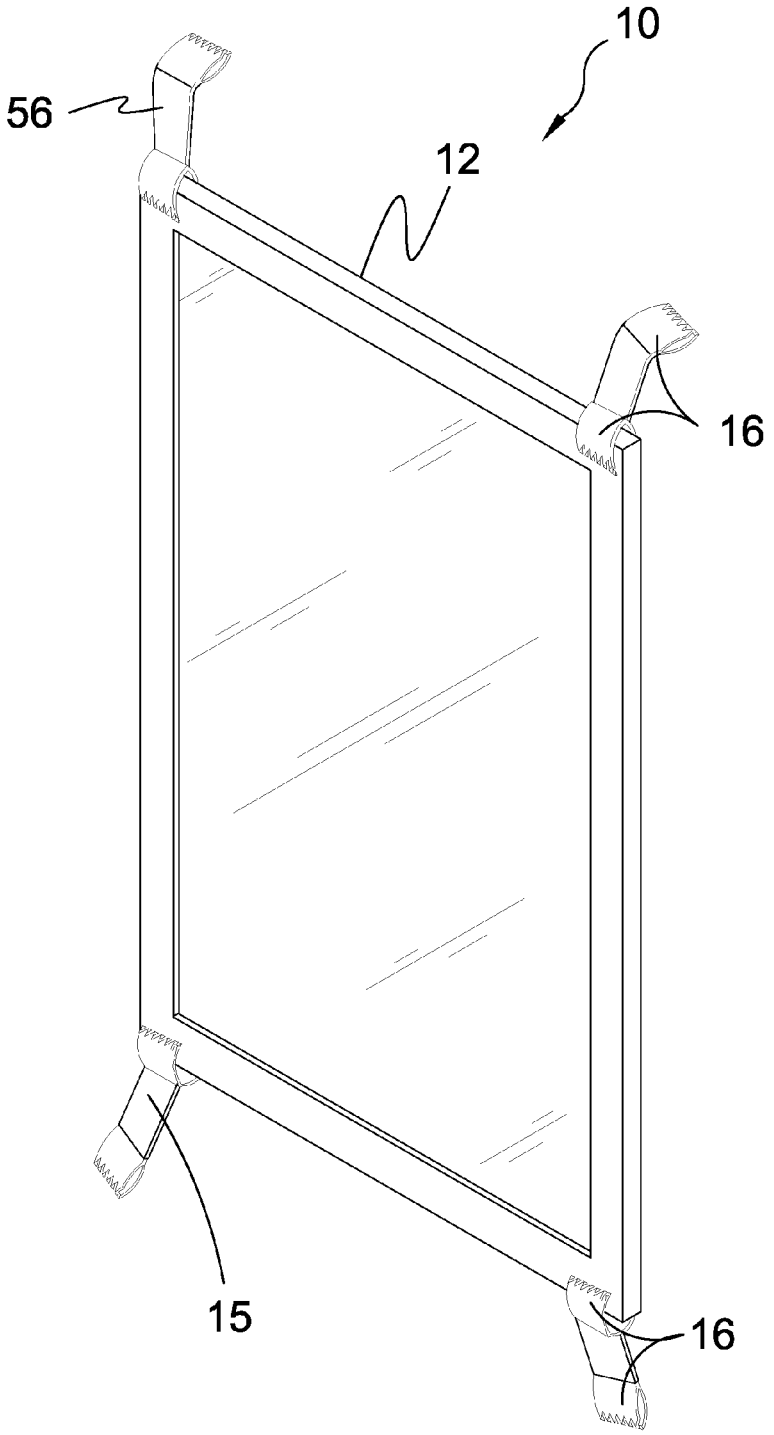
FIG. 12 is an illustrative view of the present invention.

FIG. 12 is a perspective view of another additional element of the display frame 12 of the present invention 10. Depicted is another additional element of the present invention 10 comprising a display frame 12 having a pair of fixedly attached top straps 56 and bottom straps 15 on the top and bottom of the display frame 12 with each terminating in double suspender-like clips 16 with plastic inserts. The display frame 12 can be attached and detached as desired by the user to an article of apparel or other desired article.

Figure 12A:
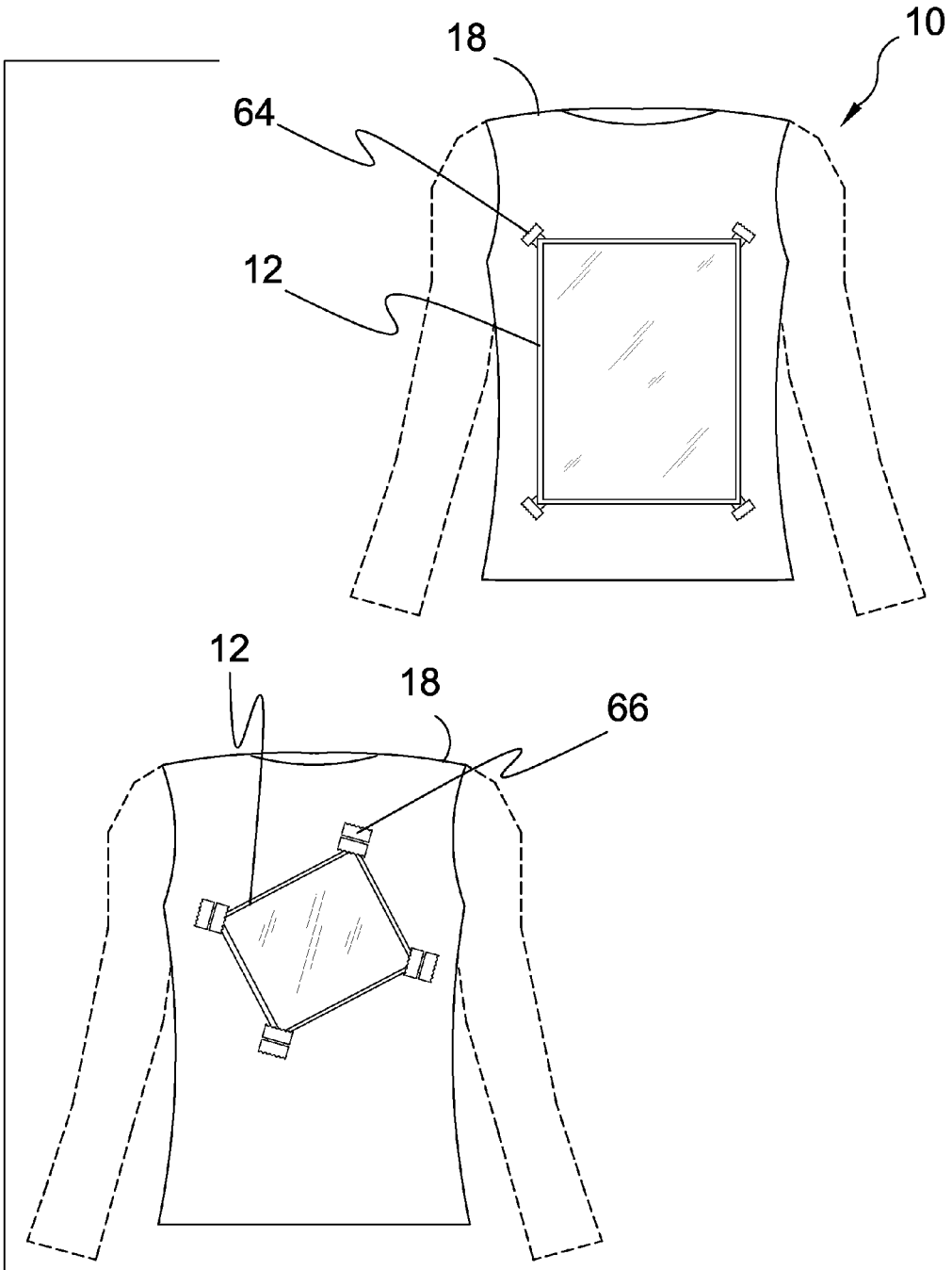
FIG. 12A is an alternate means of attaching the frame of the present invention.

FIG. 12A is an illustrative view of the single clip 64 and double clip 66 display frames 12 of the present invention 10 in use. Depicted are the single suspender clips 64 and double suspender clips 66 with plastic inserts display frame 12 comprising a pair of fixedly attached straps on the top and bottom of the display frame 12 with each terminating in single 64 or double 66 suspender-like clips with plastic inserts. The display frame 12 can be attached and detached as desired by the user to a garment 18 or other desired article.

Figure 13:
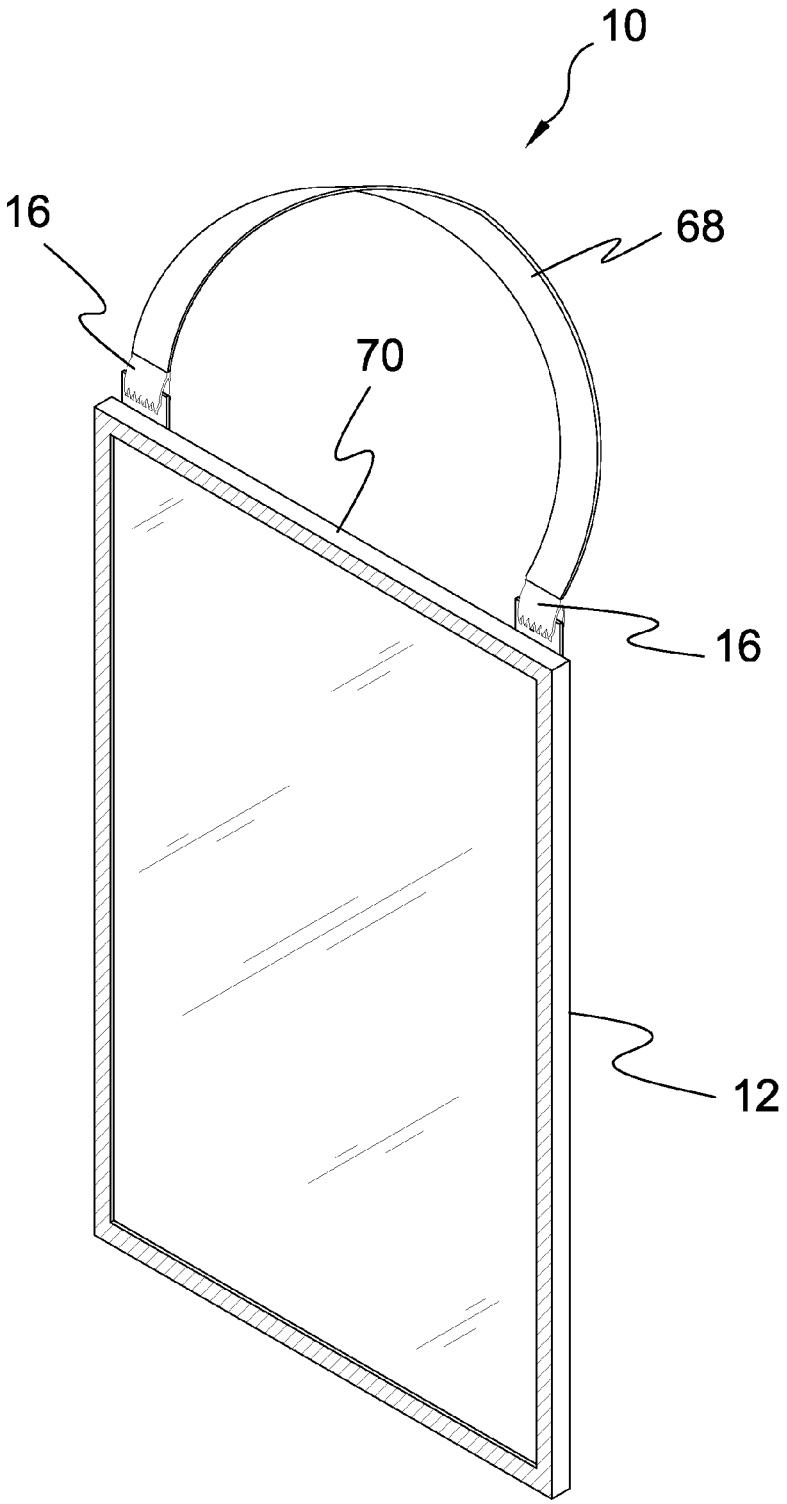
FIG. 13 is an illustrative view of the present invention.

FIG. 13 is a perspective view of the present invention 10 having a single clip attachable strap 68. The single clip attachable strap 68 has suspender type clips 16 disposed on the ends thereof that grasp opposing ends of the top 70 of the display frame 12 to suspend it from a user or object.

Figure 13A:
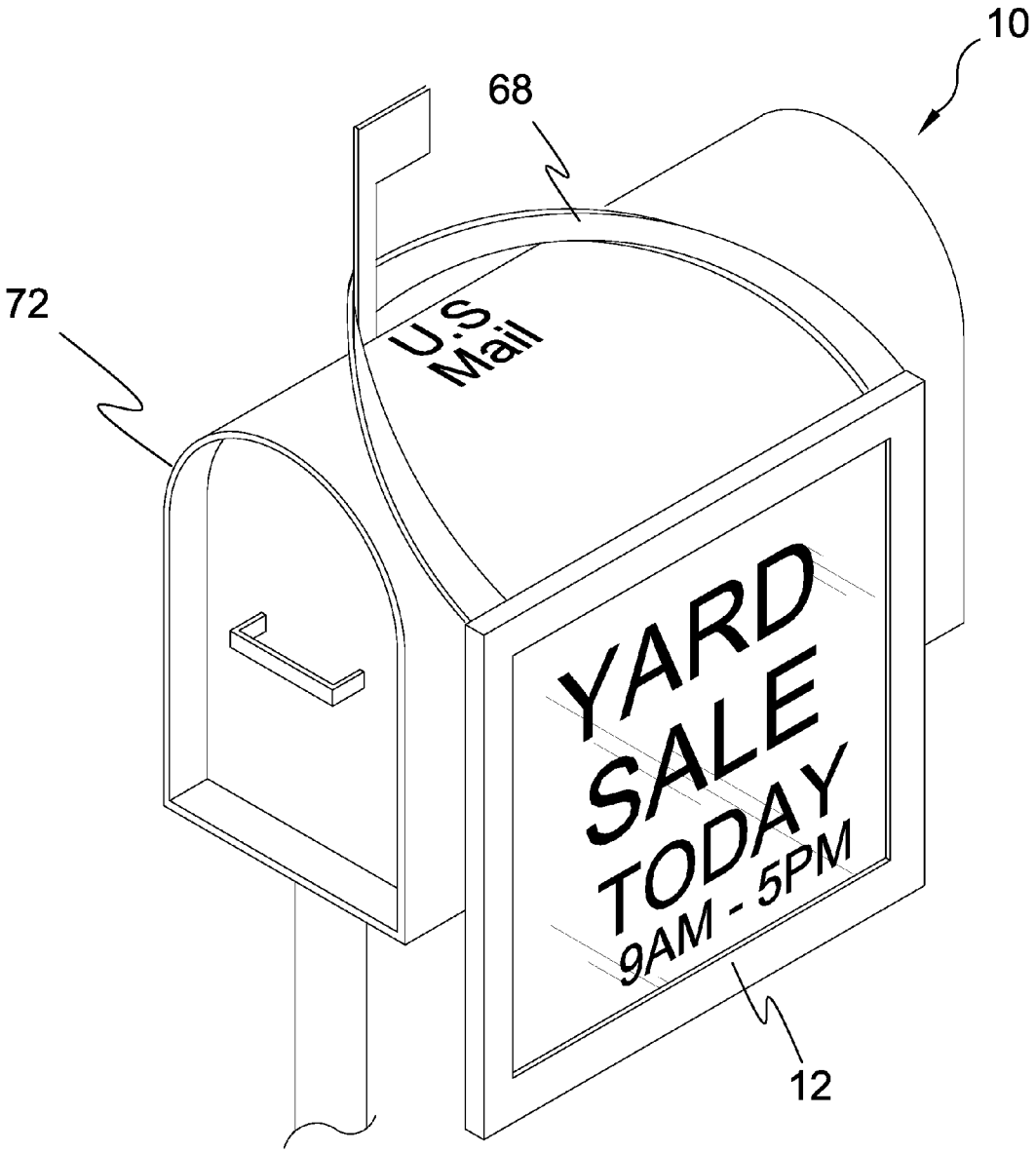
FIG. 13A is an illustrative view of the present invention.

FIG. 13A is an illustrative view of the present invention 10. Shown is one method of use single clip attachable strap 68 suspending the display frame 12 from a mail box 72. The portable, removably attachable frame 12 can also be used to display yard sale, house for sale, birthday party, newborn or other messages.

Figure 14:
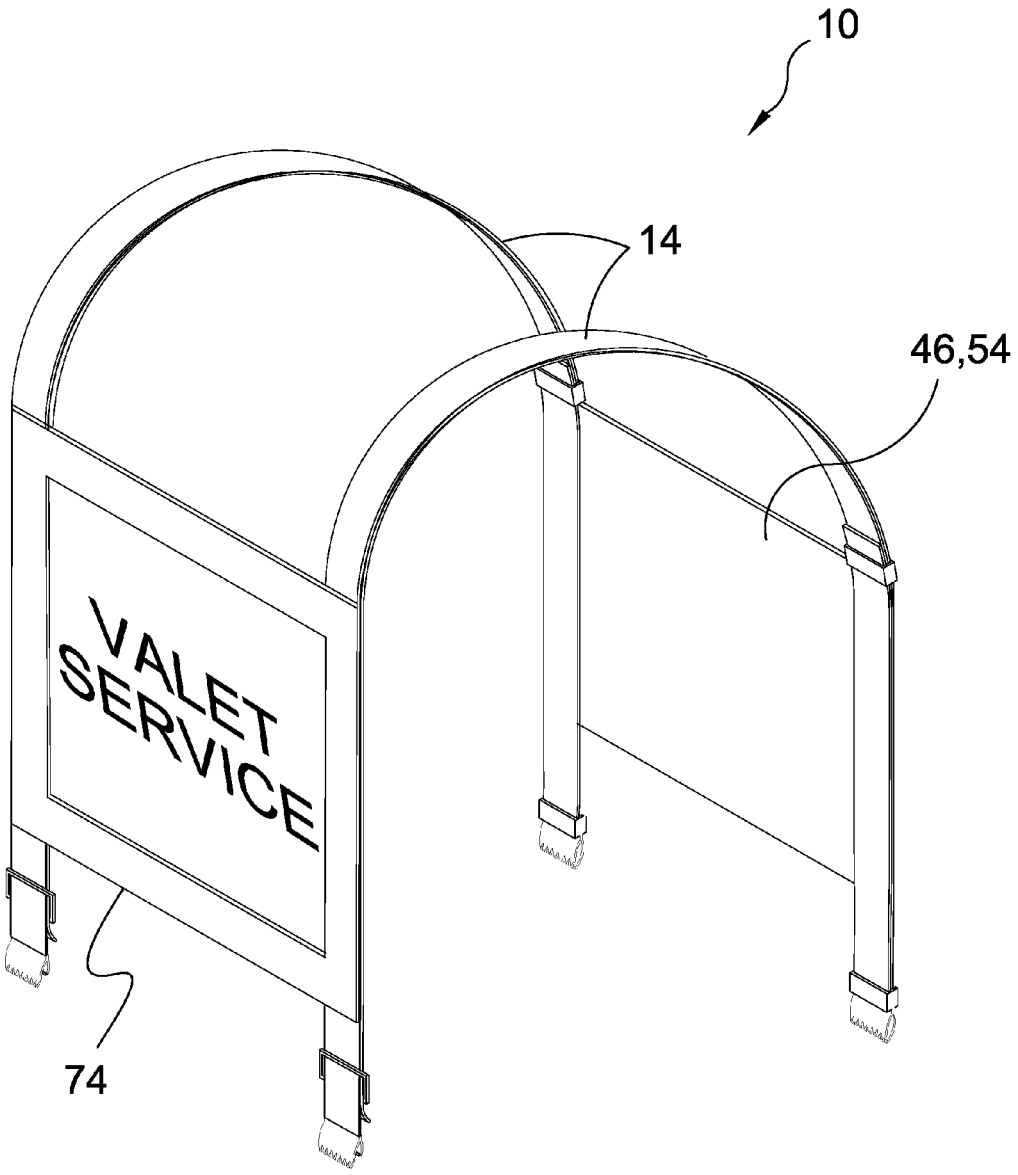
FIG. 14 is an illustrative view of the present invention.

FIG. 14 is an illustrative view of the present invention 10. Shown is one method of use of the present invention 10 to be displayed on adjustable full length shoulder straps 14. The permanently sewn frame 74 is made of strap material. One accesses the frame 74 from the back using fasteners such as hook and loop fasteners 54 or other various fastener elements 46.

Figure 14A:
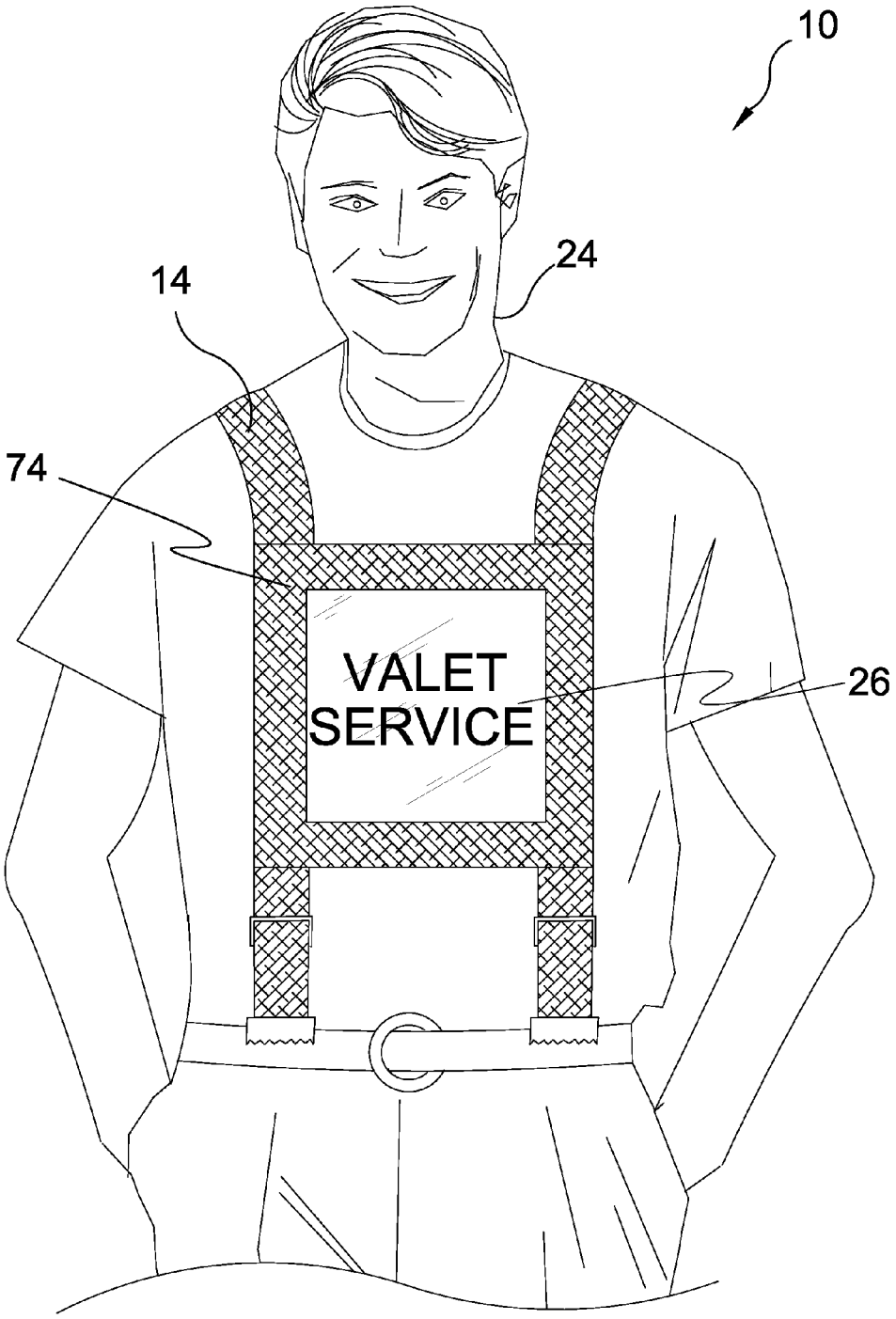
FIG. 14A is an illustrative view of the present invention.

FIG. 14A is an illustrative view of the present invention 10. Shown is one method of use of the permanently sewn display frame 74 displayed on adjustable shoulder straps 14 worn by the user. It is a permanently sewn frame made of strap material with a detachable back to access display items 26.

Figure 15:
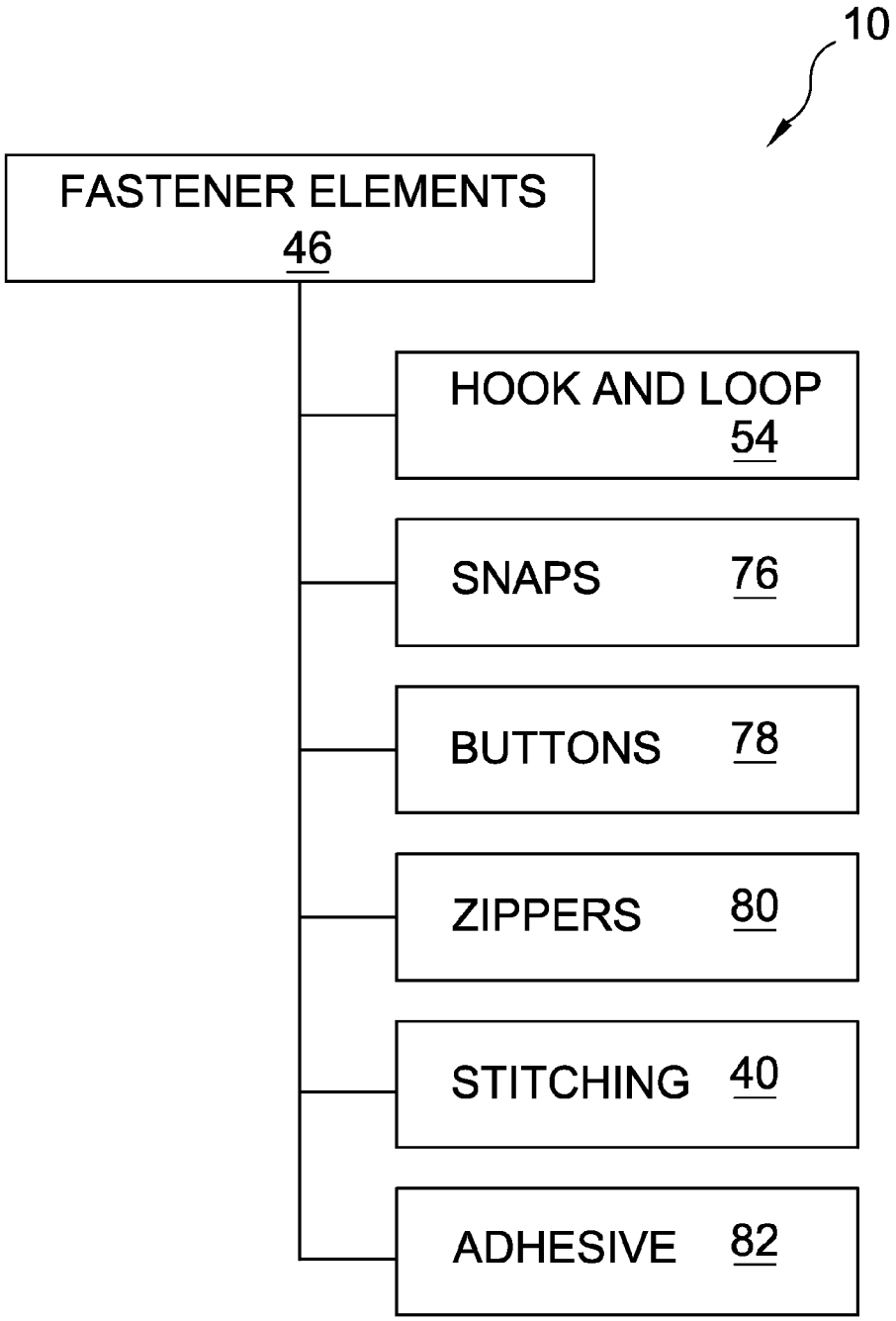
FIG. 15 is a block diagram of the possible fastener elements.

FIG. 15 is a block diagram of potential fastener elements 46 that may be employed by the present invention 10. The fastener elements are selected by the group of hook and loop 54, snaps 76, buttons 78, zippers 80, stitching 40 and adhesive 82.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A tethered display frame, comprising:

a rectangular planar backer sheet;

a top sheet of transparent or translucent material overlaying said planar backer sheet;

a border attached over said top sheet along a common periphery of said planar backer sheet and said top sheet, said border being generally rectangular and a first frame being closed on upper and lower edges and on one side, with another side provided with an opening between said top sheet and said backer sheet for a user to insert a display item between said top sheet and said planar backer sheet, said opening being releasably sealable between said top sheet and said back sheet;

frictional fabric sewn between said planar backer sheet and said top sheet for nonslidingly securing said display item therebetween;

a first pair of spaced parallel shoulder straps adapted to extend over a shoulder of a user engaging an upper end of said first frame, a second pair of spaced parallel vertically extending bottom straps engaging a lower end of said first frame, both said first and second pairs of spaced parallel shoulder and bottom straps having opposite ends engaged to support trousers of said user;

said first pair of shoulder straps being secured to said upper end of said first frame by suspender clips and said second pair of bottom straps being secured to said lower end of said first frame by suspender clips, whereby suspenders worn by a user to support an article of clothing also displays advertising material which can be readily replaced by unclipping said first frame and replacing with another frame while supported on said user;

adjustment members for varying lengths of either or both of said first and second pairs of shoulder and bottom straps to position said first frame on a user and also to accommodate a body height of a different user, said first and second pairs of shoulder and bottom straps being separately adjustable, and said second pair of bottom straps being shorter than said first pair of shoulder straps; and directly beneath said frame is mounted a second frame on said second pair of bottom straps with strips of the second pair of bottom straps interconnecting said frames in a location adapted to be on the same side of said user as said first and second frame comprised of said planar backer and top sheets, said first and second frames being completely separated from each other except for said straps.

2. A tethered display frame according to claim 1, wherein said border attaches along a common periphery of said planar backer sheet and said top sheet by means selected from the group consisting of snaps, hook and loop type fasteners, zippers, buttons and sewn stitches.

3. A tethered display frame according to claim 2, further comprising decorative elements.

* * * * *